US005277111A

United States Patent [19]

Uribe et al.

[11] Patent Number: 5,277,111

[45] Date of Patent: * Jan. 11, 1994

[54] PRINTING CYLINDER CLEANING SYSTEM

[75] Inventors: Diego Uribe, Barrington; Rolf Hantscho, Lake Zurich, both of Ill.

[73] Assignee: Ozy-Dry Corporation, Itasca, Ill.

[ * ] Notice: The portion of the term of this patent subsequent to May 5, 2009 has been disclaimed.

[21] Appl. No.: 878,435

[22] Filed: May 4, 1992

Related U.S. Application Data

[63] Continuation-in-part of Ser. No. 504,093, Sep. 18, 1990, Pat. No. 5,109,770, which is a continuation-in-part of Ser. No. 411,104, Sep. 22, 1989, Pat. No. 5,010,819.

[51] Int. Cl.[5] ..... B41F 35/00

[52] U.S. Cl. ..... 101/425; 101/424

[58] Field of Search ..... 101/423, 424, 425; 15/256.51, 256.53; 355/301, 302

[56] References Cited

U.S. PATENT DOCUMENTS

| | | | |
|---|---|---|---|
| 4,015,307 | 4/1977 | Kossak | 101/425 |
| 4,270,450 | 6/1981 | Difflipp | 101/425 |
| 4,369,734 | 1/1983 | Preuss | 101/425 |
| 4,393,778 | 7/1983 | Kaneko | 101/425 |
| 4,686,902 | 8/1987 | Allain et al. | 101/425 |
| 4,826,539 | 5/1989 | Harpold | 101/424 |
| 4,841,862 | 6/1989 | Seefried | 101/425 |
| 5,010,819 | 4/1991 | Uribe et al. | 101/425 |
| 5,109,770 | 5/1992 | Uribe et al. | 101/425 |

*Primary Examiner*—Edgar S. Burr
*Assistant Examiner*—Ren Yan
*Attorney, Agent, or Firm*—Leydig, Voit & Mayer

[57] ABSTRACT

A cleaning system for a printing line having a plurality of printing units which each include a plurality of printing cylinders, such as blanket cylinders and/or plate cylinders. The cleaning system includes a cleaning device associated with each printing cylinder, which includes a rotatable brush roller that is selectively movable into and out of engagement with the respective printing cylinder. Each cleaning device further includes a cleaning fluid distribution tube for applying cleaning fluid to the brush roller to facilitate removal of foreign matter from the printing cylinder during a cleaning operation and a flicker bar that is selectively engageable with the brush roller to effect removal of foreign matter and used fluid carried thereby. Each printing unit includes an associated control module that is operable for connecting the cleaning devices of the associated printing unit with outside pneumatic, hydraulic, cleaning fluid, and electrical power sources and for controlling the operation of the cleaning devices of the associated printing unit.

19 Claims, 15 Drawing Sheets

FIG. 12
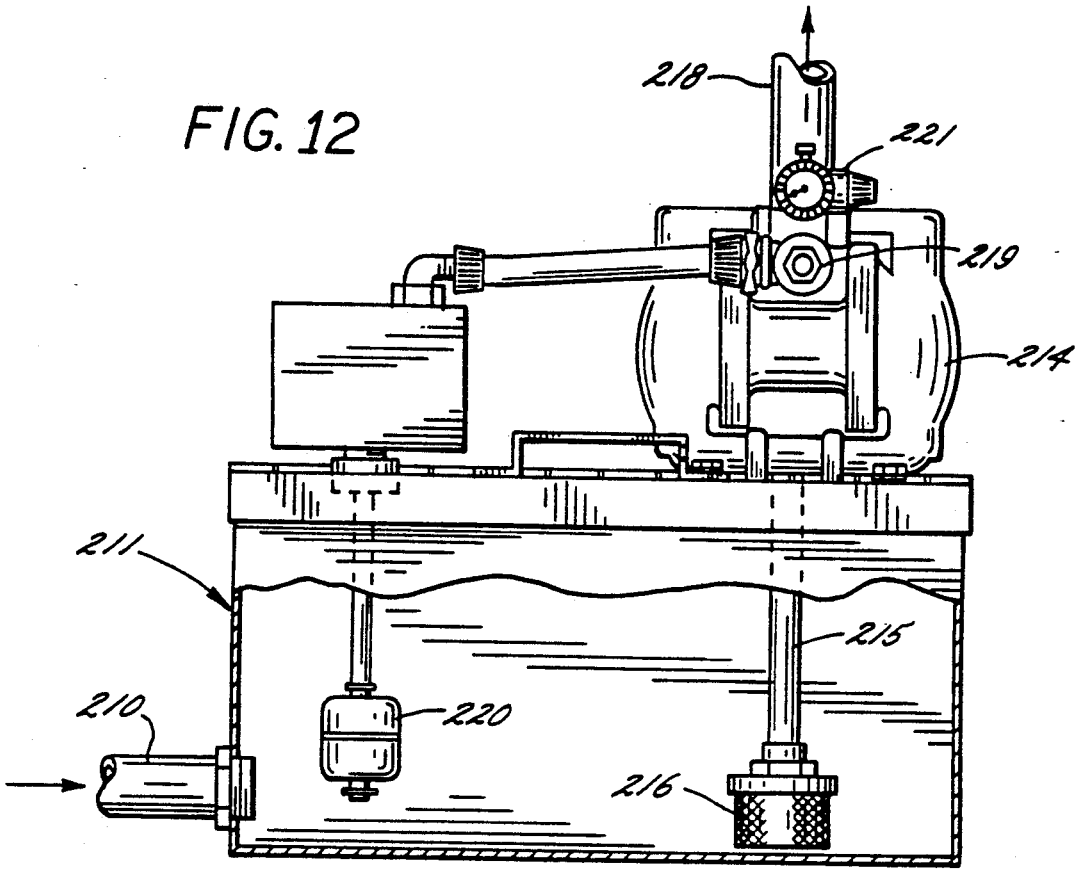
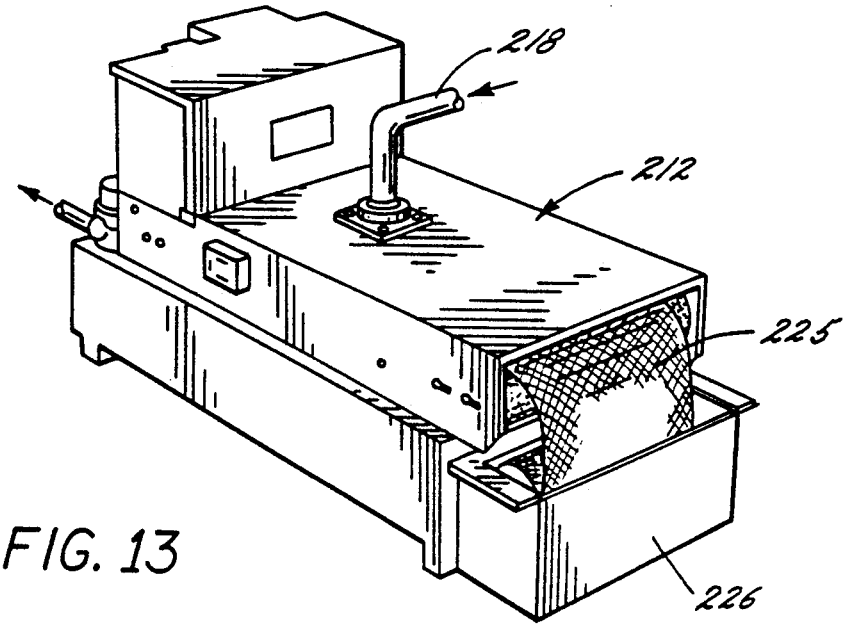
FIG. 13

PRINTING CYLINDER CLEANING SYSTEM

CROSS-REFERENCE TO RELATED APPLICATION

This is a continuation-in-part of application Ser. No. 07/584,093 filed Sep. 18, 1990, now U.S. Pat. No. 4,109,770 which in turn was a continuation in part of application Ser. No. 07/411,104 filed Sep. 22, 1989, now U.S. Pat. No. 5,010,819.

FIELD OF THE INVENTION

The present invention relates generally to printing presses, and more particularly, to a system for cleaning rotating cylindrical surfaces such as, for example, the blankets of blanket cylinders in offset printing presses and the plates of plate cylinders in plate printing presses.

BACKGROUND OF THE INVENTION

During the operation of printing presses, the blankets on the blanket cylinders and the plates on the plate cylinders accumulate foreign matter, such as dried ink or ink build-up, paper, lint, clay, dirt and the like that must be removed to maintain high quality printing. As a result thereof, during a specific run or printing job, the blankets and plates must be cleaned at various times. The blankets must also be cleaned to remove the image when a particular printing job is completed.

To be effective, the blanket and plate cleaning devices must be capable of removing the foreign matter from the surface being cleaned and then discharging such removed materials from the cleaning device. For this purpose, as shown in U.S. Pat. No. 4,015,307 assigned to the same assignee as the present application, blanket cleaning devices are known which include a cylindrical brush roller that is engageable with the blanket cylinder and rotatable against the blanket or plate cylinder. Solvents preferably are applied to the brush roller during the scrubbing cycle to enhance the cleaning action, and a flicker bar is mounted in engaging relation with the underside of the brush roller for causing the bristles of the brush to flex as they are directed over the flicker bar and eject foreign matter and solvent carried by the brush roller from the blanket cylinder.

While such cleaning devices have been found to effectively clean blanket cylinders, they have had certain design and operating limitations. Since the brush roller rotates against the blanket cylinder and the flicker bar engages the underside of the brush roller, reactionary forces exerted on the brush roller by the resistance of the flicker bar increase the pressure by which the brush roller bears against the blanket cylinder. When the brush roller strikes a gap in the blanket cylinder between blankets, the brush roller tends to be suddenly urged forwardly and then bounce rearwardly in reaction thereto. As the speed of the brush roller increases, so does the bouncing and vibratory action of the brush roller, which can result in undesirable streaking on the blanket being cleaned. The speed of brush roller rotation, therefore, must be limited to prevent such streaking. Moreover, since rotation of the brush roller is resisted both by its engagement with the blanket cylinder, as well as the flicker bar, a relatively high torque drive motor generally is required for the brush roller. The action of the flicker bar on the brush roller, furthermore, has been found to remove approximately 10 to 25 percent of the solvent that is applied to the brush roller during the cleaning operation. Hence, the cleaning device must be provided with solvent in sufficiently large quantities to compensate for the amount of solvent that is removed by the flicker bar, which increases the operating costs of the system.

It also is necessary that blanket and plate cleaning devices not allow excessive amounts of solvent to be applied to the moving sheet material. Since dryers utilized in high quality printing lines can accommodate only predetermined levels of solvent without creating a potentially flammable condition, caution must be taken to ensure that solvent applied to the blankets and plates during a cleaning operation and in turn to the sheet material for transport through the dryer does not exceed the capacity of the dryer. Indeed, while it is often desirable to employ four to ten printing units operating on a moving web, depending upon the color and printing requirements, the number of printing units may be limited by the amount of solvent that is imparted to the web from the blanket and plate cleaning devices. Hence, the capacity of the dryer, together with the amount of solvent applied to the web by the blanket or plate cleaning devices, can limit the printing units that may be available for the printing operation. Since heretofore it has been difficult to precisely control the amount of solvent applied to the web, it has been equally difficult to reliably determine the maximum number of printing units that may be employed without exceeding the safety limits of the dryer.

The blanket and plate cleaning devices, furthermore, must permit reliable discharge of solvent and foreign matter removed from the brush roller without creating a clogged or overflow condition that can cause the brush roller to apply excessive solvent to the moving web. In addition, in prior blanket and plate cleaning devices dangerous conditions can result in the event of a breakdown or malfunction in the mechanical or control systems of the cleaning device. For example, when solenoid control valves are employed, if the blanket or plate cleaning device breaks down with the valve in an open condition, solvent may be continuously directed onto the brush roller during the period of the malfunction, again resulting in the application of excessive solvent to the web or sheet material which is carried to the dryer. Moreover, in prior blanket and plate cleaning devices, it is frequently difficult to effect service or repair, and space limitations about the press often necessitate the added cost of custom design and installation.

Large newspaper printing presses have further distinct blanket cylinder cleaning requirements. A complete newspaper must be simultaneously printed on the printing press line within strict time restraints, and the need therefor has existed for maintaining the printing cylinders in a clean condition without interruption of the printing operation. Heretofore, this has created significant problems. Due to the ineffectiveness of conventional blanket cleaning devices on such newspaper printing lines the build up of contaminants on the blanket cylinders can occur to the extent that the web tends to adhere to the blanket cylinders, causing the web to ultimately be damaged or torn, which in turn interrupts the entire printing operation and results in costly down time and the waste of large amounts of paper. Large metropolitan newspapers can incur an excess of $50 million a year in waste paper alone associated with inadequately cleaned blanket cylinders.

Such large newspaper printing presses furthermore are relatively complex, comprising a number of printing towers each typically having a plurality of individually configured vertical stacks of printing units. Conventional blanket cleaning devices have not been well suited for adaptation in such printing lines without considerable custom design and engineering. A further problem with such large newspaper printing lines, particularly in metropolitan areas, is the limitation in the amount of volatile organic compounds or solvents that can be used in the printing and cleaning operations. The need for monitoring and precisely controlling the use of such volatile organic compounds has existed in order to ensure a safe environment and to maintain compliance with regulatory requirements. Again conventional blanket cleaning systems have been inadequate in that regard.

OBJECTS AND SUMMARY OF THE INVENTION

It is an object of the present invention to provide an improved blanket and plate cleaning system for printing presses that is adapted for more economical and efficient manufacture and operation.

Another object is to provide a blanket and plate cleaning system as characterized above which more precisely controls the amount of solvent used during the blanket and plate cleaning operation, and hence, enables more reliable determination of the maximum number of printing units that may be simultaneously employed in a printing operation without creating a potentially dangerous condition in the dryer of the printing line.

A further object is to provide a blanket and plate cleaning system of the above kind which is adapted for automatically interrupting the supply of solvent to the brush roller of the cleaning device in the event of a mechanical or control malfunction in the system.

Still another object is to provide a blanket and plate cleaning system of the foregoing type in which the power driven brush roller may be operable at relatively high speeds with less tendency for undesirable vibration, and thus, less tendency for causing streaking in the blanket or plate being cleaned. A related object is to provide such a blanket and plate cleaning system which includes a foreign matter removing flicker bar that does not increase the bearing pressure of the brush roller on the blanket cylinder or plate during a cleaning cycle.

A further object is to provide a blanket or plate cleaning system of the above type which requires lesser quantities of solvent. A related object is to provide such a blanket and plate cleaning system in which the flicker bar is operable for removing primarily foreign matter in the brush and only minimal amounts of solvent.

Yet another object is to provide a blanket and plate cleaning system of such type which includes modular control elements that facilitates installation and service of the system in a printing line, as well as optimum operation.

Another object is to provide such a blanket and plate cleaning system in which the rotatable brush roller can be driven with a lower torque drive motor.

Still another object is to provide a blanket and plate cleaning device that permits the reliable discharge of foreign matter and solvent removed from the brush roller during the cleaning operation and which is adapted for relatively easy cleaning and maintenance.

A further object is to provide a blanket cylinder cleaning system adaptable for effectively cleaning blanket cylinders in large newspaper printing lines without interrupting the printing operation and with minimal use of volatile organic solvents and the like.

Another object is to provide a newspaper printing line blanket cleaning system of the foregoing type which can be operated during a printing operation without incurring paper waste.

Yet another object is to provide a newspaper printing line blanket cleaning system that enables relatively precise control on the use of volatile organic compounds.

Still another object is to provide a blanket cleaning system for newspaper printing presses in which standardized cleaning devices are easily adaptable for use in a multiplicity of differently configured printing towers with minimal custom engineering.

Another object is to provide a blanket cleaning system for newspaper printing presses that can be selectively operated in wet or dry operating modes for maintaining brush rollers in clean condition for optimum blanket cylinder cleaning during a continuous printing operation.

Other objects and advantages of the invention will become apparent upon reading the following detailed description and upon references to the drawings, in which:

BRIEF DESCRIPTION OF THE DRAWINGS

FIG. 12 is a front elevation view, in partial section, of the waste effluent transfer unit for the solvent recovery system of the cleaning system;

FIG. 13 is a perspective of a flat bed filter unit for the solvent recovery system;

Figure 1:
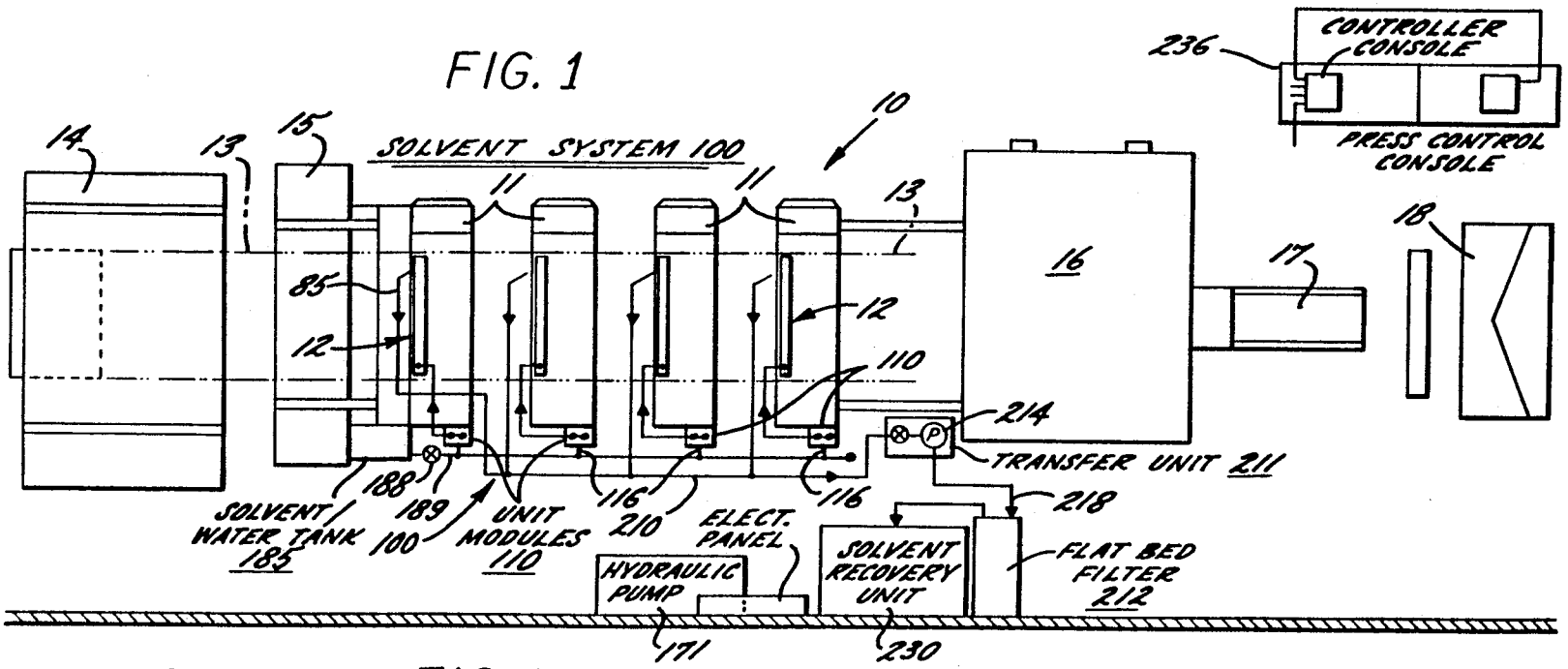
FIG. 1 is a diagrammatic top plan view of a printing line having a printing cylinder cleaning system embodying the present invention, and particularly depicting the solvent supply of the system.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention. Hence, while the invention will be described in connection with a blanket cleaning system, it will be understood that it is equally applicable to the cleaning of plates on plate cylinders of printing presses. As used herein, the term "printing cylinder" is intended to include both blanket cylinders and plates of plate cylinders.

DESCRIPTION OF THE PREFERRED EMBODIMENT

Figure 2:
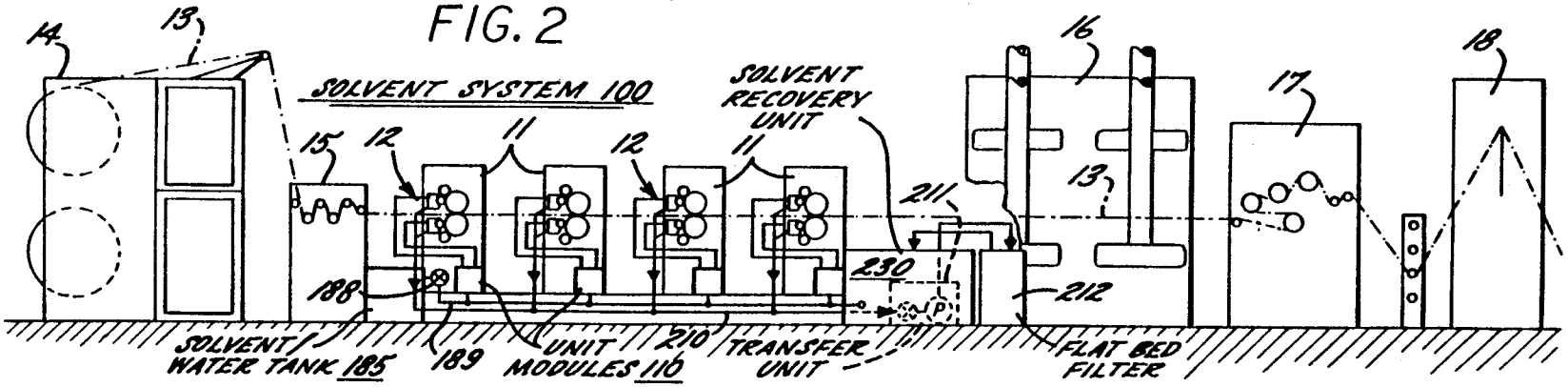
FIG. 2 is a side elevational view of the printing line shown in FIG. 1.
Figure 3:
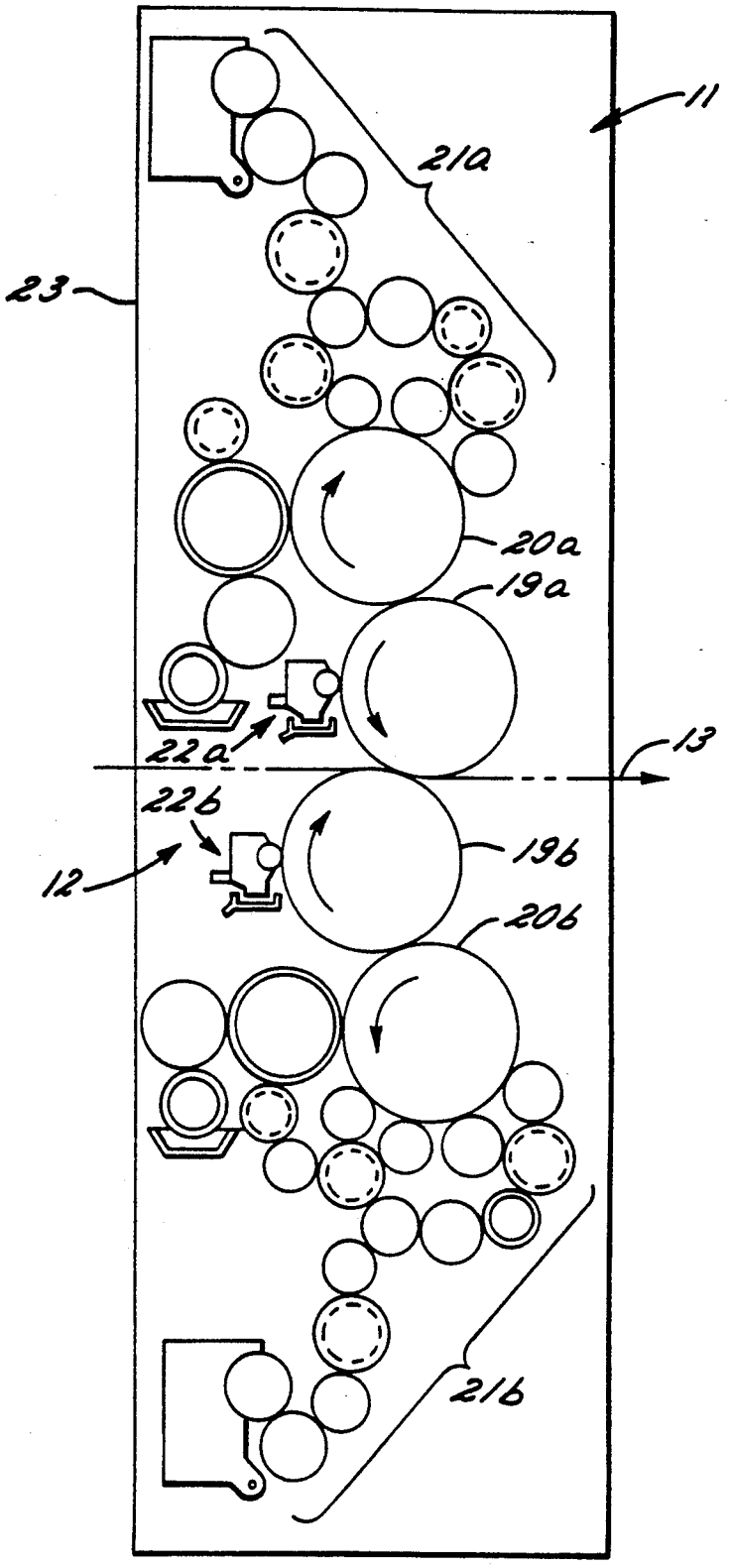
FIG. 3 is a vertical section of one of the printing units shown in the illustrated printing line.

Referring now more particularly to FIGS. 1 and 2 of the drawings, there is shown an illustrative web press printing line 10 which includes a plurality of printing units 11 having a printing cylinder cleaning system 12 in accordance with the present invention, which in this case is a blanket cleaning system. A web 13 of paper drawn from a roll stand 14 is directed through an infeed and guide device 15 and then successively through the printing units 11 where printed images of different colors may be applied to the web in a known manner. The printed web 13 exiting the printing units 11 is directed through a dryer 16, a chill roll 17, and a folder 18 or other finishing equipment. The printing units 11, as best shown in FIG. 3, each comprise an upper and lower blanket cylinder 19*a*, 19*b* which define a nip through which the web 13 passes. Each upper and lower blanket cylinder 19*a*, 19*b* has an associated plate cylinder 20*a*, 20*b* and ink feed 21*a*, 21*b* in a conventional manner.

Figure 4:
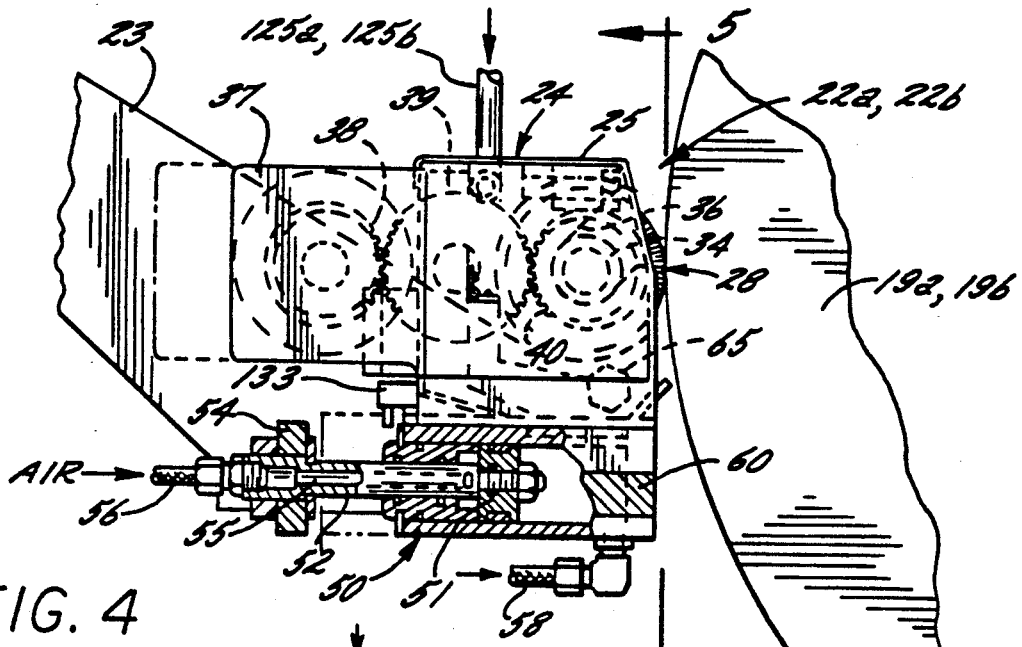
FIG. 4 is a an enlarged side elevational view of one of the cleaning devices of the illustrated cleaning system.
Figure 6:
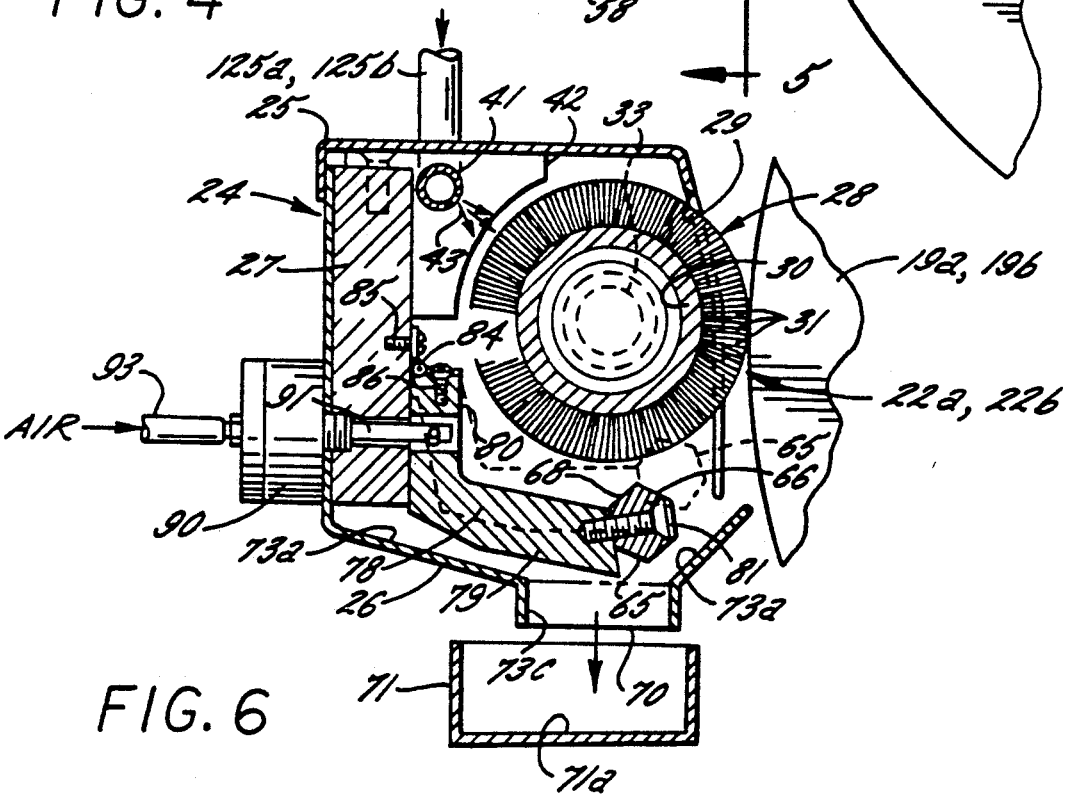
FIG. 6 is an enlarged vertical section of the cleaning device, taken in the plane of line 6—6 in FIG. 5.
Figure 5:
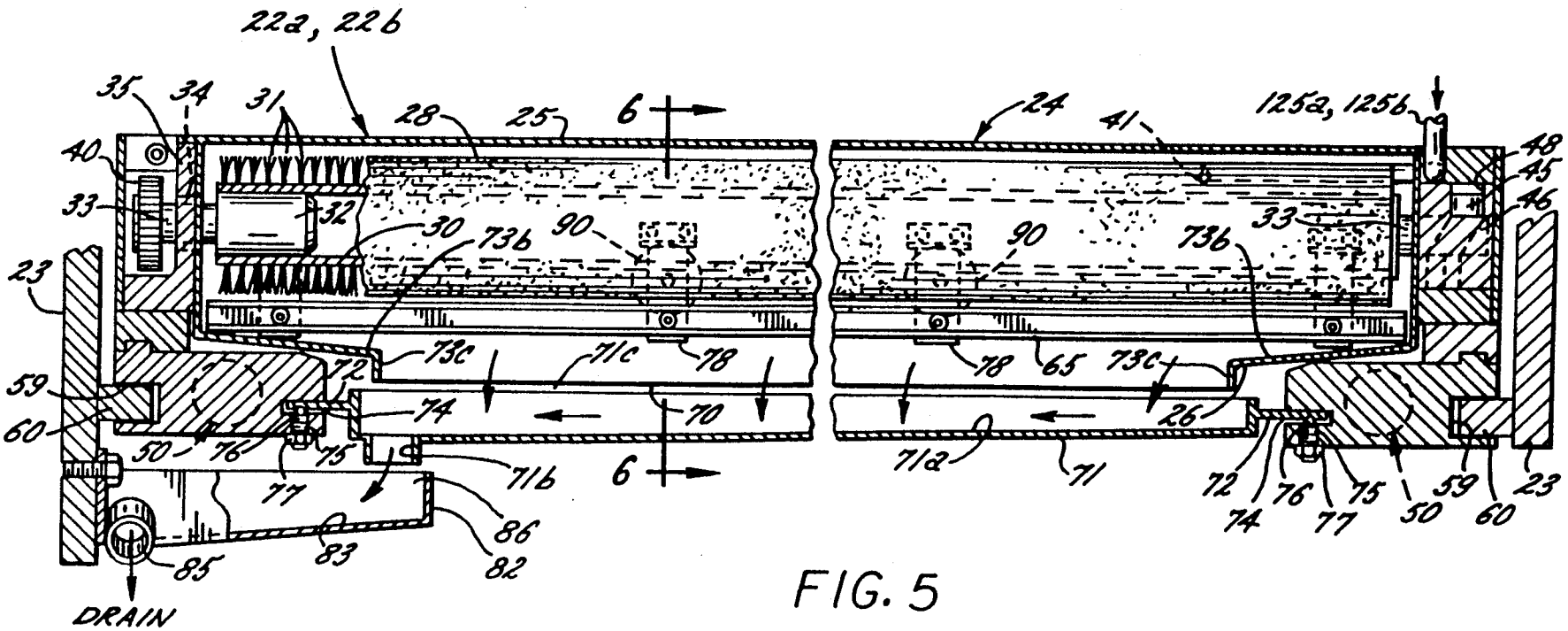
FIG. 5 is a front end view of the cleaning device, in partial section, taken in the plane of line 5—5 in FIG. 4.

For selectively cleaning the blanket cylinders 19*a*, 19*b* of each printing unit 11, each blanket cylinder 19*a*, 19*b* has a printing cylinder cleaning device 22*a*, 22*b* mounted between side frame plates 23 of the press in adjacent relationship to the respective blanket cylinders 19*a*, 19*b*, as best shown in FIGS. 4–6. Each cleaning device 22*a*, 22*b* includes a brush unit 24 having a housing comprising upper and lower sections 25, 26 mutually secured to a rear support plate 27. A brush roller 28 is rotatably supported within the housing, and the upper and lower housing sections 25, 26 define a front opening 29 through which a forward portion of the brush roller 28 extends.

The brush roller 28 may be a commercially available type employed for cleaning blanket cylinders and plate cylinders. The brush roller 28 in this instance has a cylindrical core 30 with radially extending bristles 31. The bristles 31 must be chemically resistant to the solvents that are employed, sufficiently pliable so that the surface being cleaned is not damaged, and yet sufficiently rigid so that, as will hereinafter be discussed, foreign matter may be removed from the bristles by a flexing action of the bristles. For supporting the brush roller 28, cylindrical inserts 32 (FIG. 5) are provided in opposite ends of the core 30, with the inserts each having an outwardly extending support shaft 33. To enhance servicing of the brush roller 28, it may be mounted in appropriate bearings 34 that are mounted in bearing block support plates 35 located at opposite ends of the housing which are formed with outwardly opening shaft receiving slots 36 (FIGS. 4 and 5). An appropriate removable retaining clamp is provided in the end of each slot 36 for maintaining the brush roller 28 in mounted position.

For rotatably driving the brush roller 28, a motor 37, which in this case is a hydraulic motor, is mounted rearwardly of the brush unit housing. The hydraulic motor 37, which may be of a known type, has a drive pinion 38 (FIG. 4) engageable with an intermediate gear 39 supported by the adjacent bearing block support plate 35, which in turn is engageable with a brush roller gear 40 mounted on the shaft 33 at the left hand side of the brush roller 28, as viewed in FIG. 5. The hydraulic motor 37 may be coupled to a pressurized hydraulic fluid supply source, as will be discussed below, by flexible feed and return lines so that when pressurized fluid is supplied to the feed line the motor drives the output pinion 38, which in turn drives the intermediate and brush roller gears 39, 40. The brush roller 28 is rotatable against the surface of the blanket or plate being cleaned and at a rate such that effective cleaning is accomplished. The speed at which the brush roller is rotated can be varied within wide limits, the principal criteria being that the speed is sufficiently high to provide effective cleaning in a minimum time.

For applying cleaning fluids to the brush roller during a cleaning operation, a cleaning fluid distribution tube 41 is disposed in the upper rear corner of the brush unit housing, as viewed in FIG. 6. The distribution tube 41 is supported between a plurality of laterally spaced support brackets 42 mounted in the corner of the brush unit and is formed with a plurality of laterally spaced holes 43 adapted for directing cleaning fluid onto the brush roller 28 on a side opposite the housing opening 29. The number and spacing of holes 43 in the distribution tube 41 should be sufficient to wet the entire length of the brush roller 28. Water preferably is directed through the tube 41, as well be described below, for application on the brush roller 28 and then the printing cylinder in order to permit the printing cylinder to be cleaned of gum, clay coatings, antioffset powders and other water soluble materials which may be on the blanket or plate. An organic solvent also preferably is directed through the distribution tube 41 for removing ink and other like substances remaining on the blanket or plate. The organic solvents employed may be any of a variety of commercially available solvents, which may, for example, comprise a mixture of aliphatic hydrocarbons, xylene and glycol monoether.

To enhance the scrubbing and cleaning action of the brush roller 28, means preferably are provided for causing the brush roller to oscillate as it is rotating. In the illustrated embodiment, one of the brush roller shafts 33 has an outwardly extending cam follower 45 (FIG. 5).

Cam plates 46 mounted on the brush unit housing define an annular cam groove 48 with a predetermined cam profile within which the cam follower 45 is disposed. Upon rotation of the brush roller 28 by its drive assembly, the cam follower 45 rides on the cam profile causing the brush roller to simultaneously reciprocate in an oscillatory manner. As is known in the art, the drive pinion 38 for the drive motor 37 has sufficient width to accommodate such oscillating movement of the brush roller and its drive gears 39,40.

For moving the brush unit 24 between an operative position with the brush roller 28 in driving engagement with the blanket cylinder 19 (FIG. 4) and a retracted or inoperative position with the brush roller 28 removed from the blanket cylinder 19, a pair of air cylinders 50 are mounted on the underside of the brush unit 24 at opposite ends thereof (FIGS. 4 and 5). Each air cylinder 50 has a piston 51 with a rearwardly extending follower rod 52 affixed to extended guides 60 of the frame plates 23 of the press by respective brackets 54. Each follower rod 52 in this case is formed with an internal passage 55 that is coupled to a pressurized air supply line 56 and communicates with the interior of the cylinder 50 on one side of the piston 51. Introduction of pressurized air through the line 56, as will be described below, causes the housing of the cylinder 50 and the brush unit 24 connected thereto to move from its operative position (FIGS. 4 and 6) to the retracted position, while the rod 52 remains affixed to the extended guides 60. Introduction of pressurized air through a line 58 in communication with the opposite side of the piston 51 causes return movement of the cylinder 50 and brush unit 24 from the inoperative position to the operative position with the brush roller 28 engaging the blanket cylinder 19. For guiding movement of the brush unit 24 between its operative and retracted positions, the housings of the cylinders 50 are formed with respective outwardly extending guideways 59, which ride on the inwardly extending guides 60 affixed to the frame plates 23 of the printing press (FIG. 5).

In accordance with one aspect of the invention, the blanket cleaning devices each include a brush roller flicker bar that is adapted for relative movement with respect to the brush roller such that the flicker bar and brush roller may be selectively brought into and out of engagement with each other for enabling removal of debris from the bristles of the brush roller by the flicker bar while the brush unit is removed from the printing cylinder and for enabling operation of the brush roller against the printing cylinder while the flicker bar is removed from the brush roller. To this end, for removing foreign matter and solvent from the brush roller 28, a flicker bar or blade 65 is provided which desirably extends the length of the brush and is adapted for engaging the underside of the brush roller 28, (as shown in phantom in FIG. 6). The flicker bar 65 has a first substantially flat surface 66 that is engageable with the underside of the brush roller in inclined relation to the bristles of the brush roller 28 that are brought into contact with the flicker bar 65 such that the individual bristles 31 are caused to be sequentially and progressively bent as they pass over the flicker bar and then allowed to quickly return to their normal positions so as to effect removal of the solvent and foreign matter from the brush. To permit such quick return movement of the bristles 31, the flicker bar 65 in this instance has a second inclined surface 68 rearwardly of the first surface 66, with the surfaces 66, 68 forming a generally pointed upper portion of the flicker bar 65. By virtue of the direction of rotary movement of the brush roller 28 and the position of the flicker bar 65 on the underside thereof, it can be seen that solvent and foreign matter dislodged from the brush roller 28 as the bristles 31 pass over the flicker bar are deflected downwardly and in a direction away from the front opening 29 of the brush unit 24.

For supporting the flicker bar 65 for movement between a first position, in which the flicker bar is in engagement with the brush roller (shown in phantom in FIG. 6) and a second position removed from the brush roller (shown in solid lines in FIG. 6), a plurality of L-shaped arms 78 are provided. Each L-shaped arm has a first generally horizontal leg 79 supporting the flicker bar 65 at an outer end thereof by bolts 81 and a second upstanding, generally vertical leg 80 pivotably secured to the housing of the brush unit 24 by hinge plates 84. The hinge plates 84 each have one leg secured to the support plate 27 of the housing by fastening screws 85 and a second leg secured by fastening screws 86 to the end of the upstanding leg 80 of the flicker bar support arm 78.

For pivoting the flicker bar support arms 78 and the flicker bar 65 carried thereby between the first and second positions, a plurality of air cylinders 90 are mounted on the rear of the brush unit 24 and each have a respective cylinder rod 91 extending forwardly through the housing of the brush unit 24 and pivotally coupled to one of the flicker bar support arms 78. It can be seen that upon actuation of the air cylinders 90 through communication of pressurized air to an inlet line 93, as will be described below, the rods 91 are extended to pivot the support arms 78 outwardly with respect to the brush unit support plate 27, raising the deflector bar 65 into interacting relation with the underside of the brush roller 28. Deactuation of the air cylinders 90 permits retraction of the cylinder rods 91 and return of the upstanding legs 80 of the support arm 78 to a position immediately adjacent the support plates 27 defining the rear wall of the brush unit 24, which lowers the flicker bar 65 to a position out of engagement with the brush roller 20 (FIG. 6).

For channeling solvent and foreign matter removed from the brush roller 28 by the flicker bar 65 and directing such materials away from the brush unit 24, the lower housing section 26 of the brush unit 24 has a trough-like form with an elongated, bottom discharge opening 70 extending substantially the length of the brush roller 28. In the illustrated embodiment, the discharge opening 70 has an elongated rectangular configuration defined by a pair of downwardly tapered side walls **73*a* (FIG. 6), which direct solvent and foreign matter to a location immediately below the brush roller 28 and a pair of downwardly tapered end walls 73*b* (FIG. 5) that extend under the respective opposite ends of the brush roller 28 relatively short distances so as to channel solvent and foreign matter inwardly over the cylinders 50 to the discharge opening 70. The tapered side and end walls 73*a*, 73*b* each terminate in a depending vertical lip 73*c*. Hence, foreign matter and solvent being ejected from the brush roller 28 by the flicker bar 65 is caused to be directed to and through the relatively large discharge opening 70** immediately below the brush roller.

For receiving and channeling solvent and foreign matter discharging from the housing discharge opening 70, a drain tray 71 is removably supported in vertically spaced relation immediately below the discharge opening 70. The drain tray 71 in this instance has a pair of outwardly extending arms 72 at opposite ends thereof that are received in respective inwardly opening slots 74 in the housings of the air cylinders 50. Releasable retaining means are provided for securing the arms 72 in mounted position. The retaining means in this case include spring loaded retainers which each comprise a screw 75 threaded in engagement in an aperture extending from the underside of the housing of the respective cylinder 50 into the arm receiving slot 74. The upper end of the screw 75 is recessed for housing a spring biased detent ball 76, which will releasably engage a detent or aperture formed in the underside of the arm 72 upon positioning of the arms 72 into the slots 74. A retaining nut 77 secures the screw 75 in mounted position.

The drain tray 71 has an open top rectangular configuration that completely underlies the housing discharge opening 70. The drain tray 71 has a bottom panel 71*a* tapered downwardly to the left, as viewed in FIG. 5, for directing solids and fluids toward a drain opening 71*b* adjacent the end of the tray. The drain tray 71 preferably is configured such that the upper peripheral edge 71*c* thereof is disposed in spaced relation below the lower peripheral edge of the discharge opening lip 73*c*. Such clearance between the drain tray 71 and the discharge opening lip 73*c* permits relatively easy removal and replacement of the drain tray 71, and in the unlikely event that the drain 71*b* should become clogged, the accumulation of solvent and foreign within the drain tray 71 can rise only to the upper level of the drain tray, thereby preventing a condition in which the underside of the brush roller 28 might contact accumulated solvent and cause excessive amount of solvent to be applied to the moving web.

The drain tray 71 in the illustrated embodiment discharges into a drain trough 82 supported in cantilever fashion from the side frame plate 11 on the left hand side of the unit, as viewed in FIG. 5. The drain trough 82 has a bottom wall 83 that is tapered downwardly to a drain 85 and is coupled to a discharge line for directing the solvent and foreign matter to a solvent recovery system, as will be described below, in order to permit reuse of the solvent. The upper peripheral edge 86 of the drain trough 82 again is disposed in vertically spaced relation below the lower peripheral edge of the drain 71*b* so as to prevent interference with removal and replacement of the drain tray 71.

In accordance with an important aspect of the invention, each printing unit has a respective control module that includes the essential components for controlling operation of the printing cylinder cleaning devices for the associated printing unit. The modules each are located in close proximity to a respective printing unit and further serve as junction boxes for permitting quick and standardized connections of electrical, solvent, water, pneumatic, and hydraulics for the cleaning devices of the associated printing unit from outside supply sources. In the illustrated embodiment, the printing cylinder cleaning system 12 includes a solvent system 100 (FIGS. 1 and 2), a water supply system 101 (FIGS. 14 and 15), a hydraulic system 102 (FIGS. 16 and 17), a pneumatic system 104 (FIGS. 18 and 19), and an electrical system 105 (FIG. 20), and each printing unit 11 has a respective control module 110 for connecting such systems to the cleaning devices 22*a*, 22*b*, for the associated printing unit 11 and for providing close proximity control of the operation of the cleaning devices 22*a*, 22*b*. Each module 110, as best shown in FIGS. 7–10, has a box-like housing 111 with a pivotally mounted front opening door 112 for easy access. Since the modules 110 are of identical construction and operation only one need be described in detail.

In carrying out the invention, for precisely controlling the quantity of solvent supplied to the cleaning devices 22*a*, 22*b* for each printing unit 11, each module 110 includes selectively operable pump means, which in the illustrated embodiment includes a pair of positive displacement pumps 115*a*, 115*b* (FIGS. 8 and 9) each of which is operable for supplying controlled quantities of solvent to a respective one of the blanket washing devices 22*a*, 22*b* for the associated printing unit. The pumps 115*a*, 115*b* in this instance are secured in depending fashion from a top wall of the module housing 111 on opposite sides thereof. Solvent is supplied to the module 110 through a supply conduit 116 connected to the module by an inlet fitting 118. The inlet fitting 118 in turn is connected by means of a feed conduit 119 to a Tee 120 (FIG. 7) which has a pair of feed lines 121*a*, 121*b* each coupled to a solvent receiving chamber in the upper end of a respective one of the pumps 115*a*, 115*b*. Each pump 115*a*, 115*b* has a respective outlet coupled through a one-way check valve 123*a*, 123*b* to one inlet of a respective Tee 124*a*, 124*b*, which each has a cleaning fluid discharge line 125*a*, 125*b* connected thereto that communicates with the cleaning fluid distribution tube 41 for the respective cleaning device 22*a*, 22*b*.

For controlling operation of the solvent supply pumps 115*a*, 115*b*, each pump has a pair of pressurized air inlet lines 126*a*, 126*b* and 128*a*, 128*b*. The inlet lines 126*a*, 126*b* of each pump 115*a*, 115*b* are connected to a common Tee 129, which in turn is connected to one outlet of a solvent supply control solenoid 130. The air inlet lines 128*a*, 128*b* of each pump 115*a*, 115*b* are connected to a second common Tee 133, which is connected to a second outlet of the solvent supply control solenoid 130. The solvent control solenoid 130 in turn has an inlet line 131 connected to a pressurized air supply line 132 by an appropriate fitting in the top of the module 110, (FIG. 7), and an air exhaust line 133 connected to a fitting at the bottom of the module. Upon energization of the solvent control solenoid 130, pressurized air is communicated through the supply line 132, inlet line 131, solenoid 130, Tee 129, and discharge lines 126*a*, 126*b* to pressurize internal chambers of the pumps 115*a*, 115*b*, driving the pistons thereof in a downward direction, and causing solvent to be drawn into the upper end of the pumps 115*a*, 115*b* through the inlet lines 121*a*, 121*b*. Upon deenergization of the solvent supply solenoid 130, pressurized air is supplied through the solenoid 130 to the Tee 133 and inlet lines 128*a*, 128*b* which communicate with the undersides of the pumps 115*a*, 115*b*, driving the pistons thereof in an upward direction to force solvent within the pump chambers through the discharge lines 125*a*, 125*b*, and to the respective cleaning devices 22*a*, 22*b*.

Since each stroke of the solvent supply pump dispenses a predetermined quantity of solvent, it will be understood by one skilled in the art that the flow of solvent to the cleaning devices 22*a*, 22*b* for each printing unit 11 may be precisely determined by controlling operation of the solvent control solenoid 130. For permitting further selected adjustment of the solvent flow rate, each solvent supply pump 115*a*, 115*b* includes an adjusting screw 135*a*, 135*b* threadedly disposed in the underside thereof and extending into the pump chamber. Adjustment of the screw 135*a*, 135*b* inwardly into the chamber will shorten the stroke of the pump piston and reduce the quantity of solvent dispensed during each stroke. Likewise, adjustment of the screw 135*a*, 135*b* in the opposite direction will lengthen the piston stroke and increase the solvent output. Each screw 135*a*, 135*b* preferably is calibrated to facilitate selected positioning thereof, and a safety locking wire may be trained through an aperture therein to prevent unauthorized alteration of desired screw setting.

By reason of such control in the operation of the solvent supply pumps 115*a*, 115*b*, the quantity of solvent directed to the cleaning devices 22*a*, 22*b*, and hence, to the moving web 13 passing through the printing line, can be determined and controlled within relatively precise limits. With the quantity of solvent so controlled, the number of printing units 11 that may be simultaneously employed on the moving web without exceeding the solvent capacity of the dryer 16 can be more reliably determined. Moreover, in the event of a power failure or mechanical breakdown of the system, regardless of whether the pistons of the solvent supply pumps 115*a*, 115*b* are in their extended or retracted positions, the supply of solvent to the cleaning devices 22*a*, 22*b* is interrupted, preventing excessive and potentially dangerous amounts of solvent from being applied to the moving web for transfer into the dryer. With the modules 110 being located in close proximity to the respective printing units 11, pressure drops in the supply lines between the solvent supply pumps 115*a*, 115*b* and the cleaning devices also is minimized.

For supplying controlled quantities of water to the cleaning devices 22*a*, 22*b* for each printing unit 11, the control modules 110 each include a pair of water supply positive displacement pumps 140*a*, 140*b* substantially similar to the solvent supply pumps 115*a*, 115*b*. A single water supply line 141 is connected to the module 110 by an appropriate fitting 142 which in turn communicates through with a feed line 143 to a Tee 144, the opposite legs of which each are connected to inlets of the pumps 140*a*, 140*b* by respective feed lines 145*a*, 145*b*. The water supply pumps 140*a*, 140*b* are pneumatically operated similarly to the solvent supply pumps, each having pressurized air inlet lines 146*a*, 146*b* and 147*a*, 147*b*, which are coupled to respective Tees 148, 149, supplied with pressurized air under the control of a water control solenoid 150. The water supply pumps 140*a*, 140*b* each have a discharge line communicating through a respective one-way check valve 151*a*, 151*b* with an opposite leg of the Tee 124*a*, 124*b* to that which solvent is directed by the solvent supply pumps 115*a*, 115*b*, whereby the discharge from the discharge lines 125*a*, 125*b* of the Tees 124*a*, 124*b* is a mixture of solvent and water for direction to the cleaning devices 22*a*, 22*b*.

To permit operation of the cleaning devices 22*a*, 22*b* with only solvent, a switch 154 is provided in an electrical panel 155 within the module housing 111, which may be manually operated to deactuate the water solenoid 150. Alternatively, it will be understood that the solvent supply pumps 115*a*, 115*b* and the water supply pumps 140*a*, 140*b* for each module 110 could be connected to separate respective cleaning fluid distribution spray tube 41 in the cleaning devices 22*a*, 22*b* and the solvent supply pumps 115*a*, 115*b* could be operated independently of the water supply pumps 140*a*, 140*b*.

Figure 7:
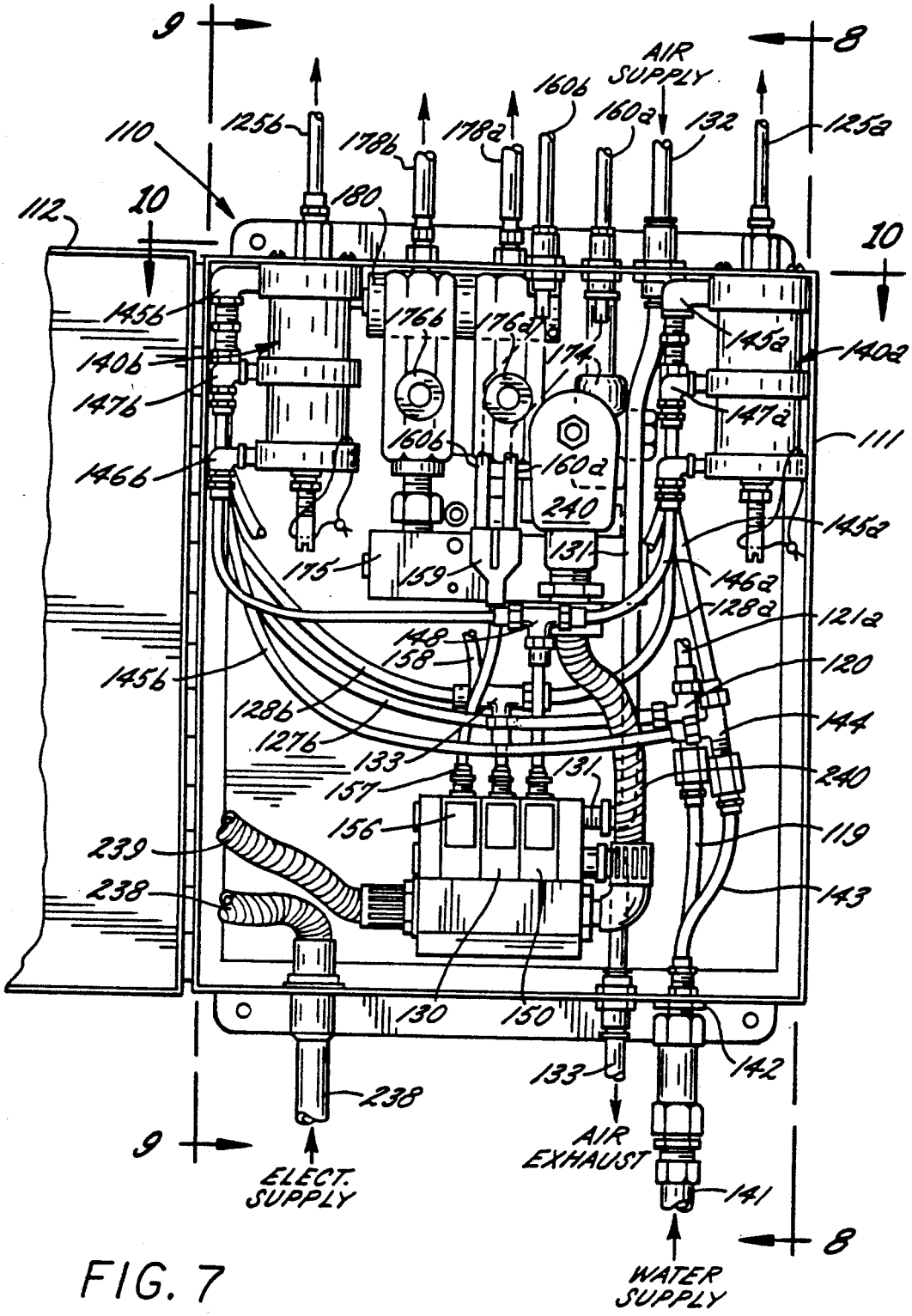
FIG. 7 is an enlarged front elevational view of one of the control modules for the cleaning system.
Figure 9:
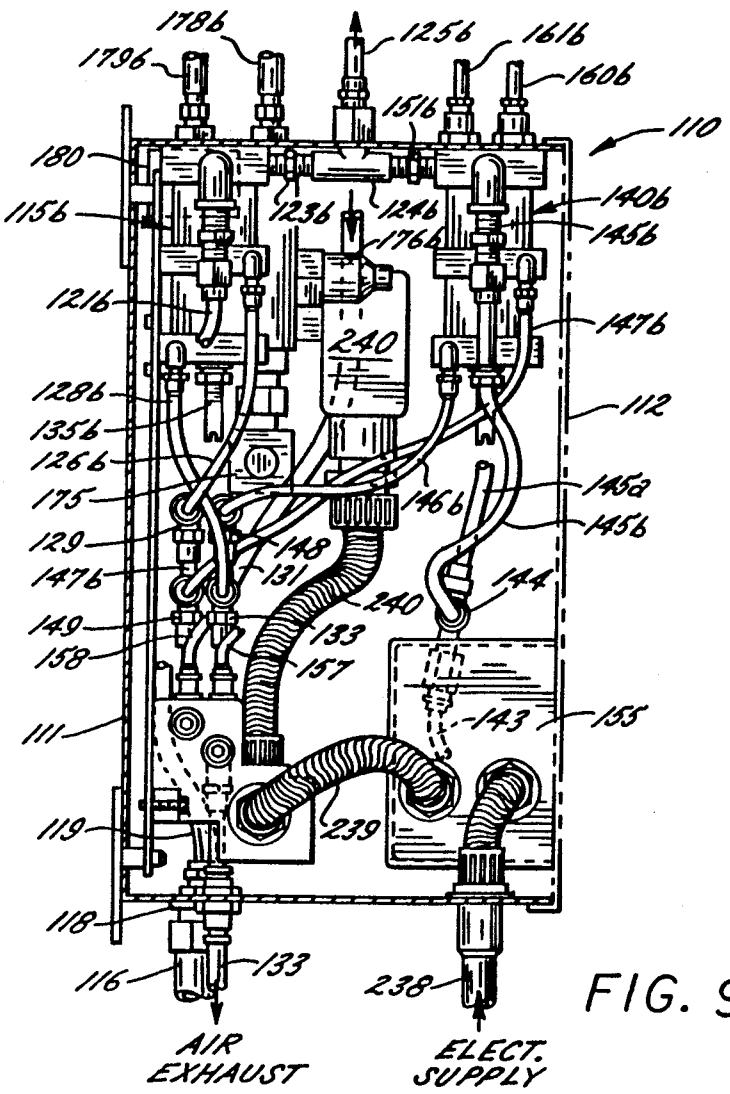
FIG. 9 is a vertical section of the control module, taken in the plane of line 9—9 in FIG. 7.

To control operation of the air cylinder 50 for each cleaning device 22*a*, 22*b* of the respective printing unit 11, and thus, to control movement of the brush units 24 between their operative and inoperative positions, each module 110 contains a scrub solenoid 156, which is connected to the air supply line 132 of the module and has a pair of discharge lines 157, 158 (FIG. 7). The discharge line 158 communicates with a Tee 159, which in turn has a pair of outlet lines 160*a*, 160*b* each of which is coupled to an air supply line 56 for a respective air cylinder 50 (FIG. 4) for the upper and lower cleaning devices 22*a*, 22*b*. The discharge line 158 communicates with a similar Tee having a pair of outlet lines 161*a*, 161*b* (See FIG. 10) each communicating with a supply line 58 of a respective one of the air cylinders for the upper and lower cleaning devices. Operation of the scrub solenoid 156, therefore, will permit communication of pressurized air to the air cylinder supply lines 56 for moving the brush units 24 of the cleaning devices 22*a*, 22*b* for the associated printing unit into operative position, and alternatively, to the supply lines 58 for returning the brush units 24 to their inoperative positions.

For moving the flicker bar 65 into engaging relation with the brush roller 28 in timed relation to movement of the brush unit 24 toward its retracted or inoperative position, in the illustrated embodiment, the air discharge line 158 for the scrub solenoid 156 also is connected, such as through appropriate Tees (not shown), to the air cylinder 90 for the respective upper and lower cleaning device 22*a*, 22*b*. As a result, upon deactuation of the scrub solenoid 156 and introduction of pressurized air to the discharge line 158 and inlet lines 58 for the brush unit cylinders 50 for causing the brush units to move to their retracted positions, pressurized air simultaneously is supplied to the inlet lines 93 for air cylinders 90 for the brush units 24 for moving the flicker bar 65 into engaging relation with the brush roller 28. Likewise, actuation of the scrub solenoid 156 terminating communication of pressurized air to the solenoid discharge line 158 and the brush unit inlet line 58 simultaneously terminates communication of pressurized air to the flicker bar cylinder inlet line 93, causing the flicker bar to retract from the brush roller as the brush unit 24 is moved into engagement with the blanket cylinder. It will be understood that the air supply to the respective air cylinders 90 for the upper and lower flicker bars 65 could be controlled by a separate solenoid coupled to the air supply 132 of the modules 110, which in turn could be actuated by an appropriate limit switch 133 (see FIG. 4) contacted upon retracted movement of the brush unit 24, or alternatively, controlled by the microprocessor based control for the system, as will become apparent. Preferably, the flicker bar 65 is moved into engaging relation with the brush roller 24 promptly upon initiation of retracting movement of the brush roller 24 away from the blanket cylinder and is returned to a retracted position prior to re-engagement of the brush roller with the blanket cylinder.

Figure 16:
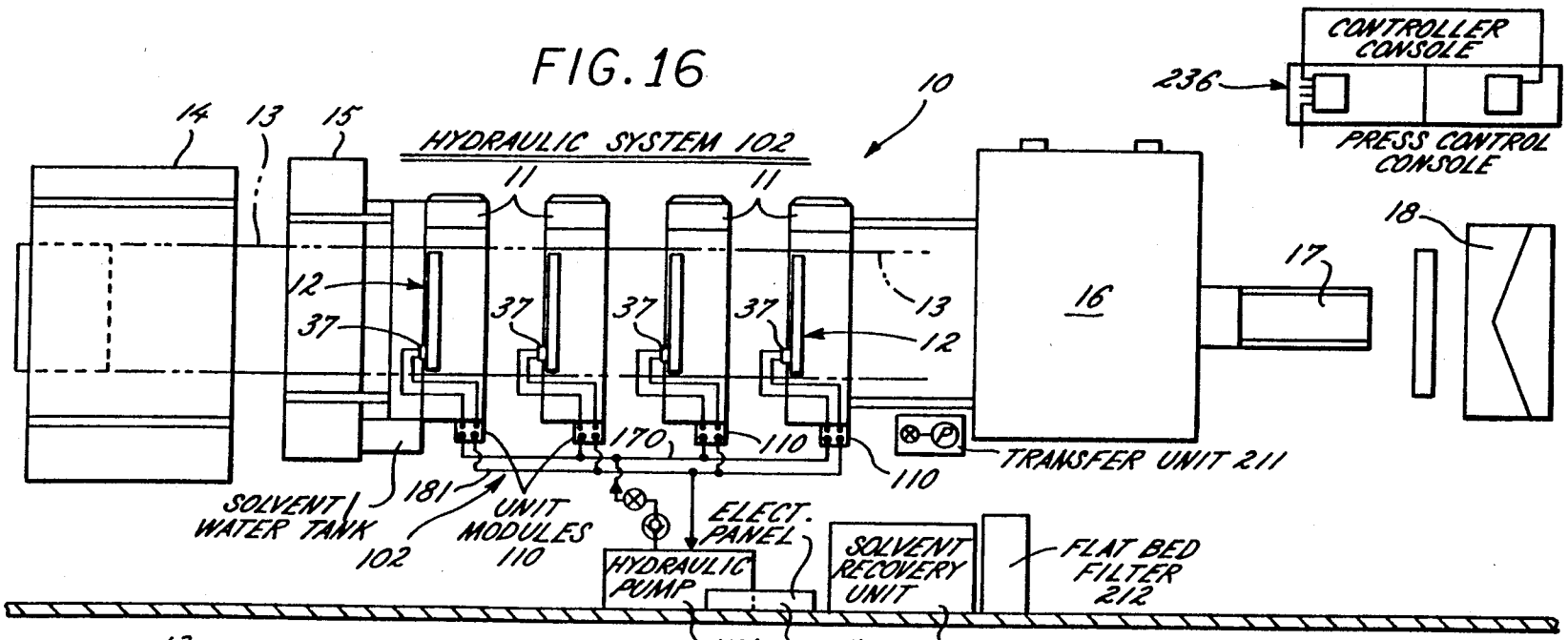
FIG. 16 is a top plan view of the printing line, particularly depicting the hydraulic supply of the cleaning system.
Figure 17:
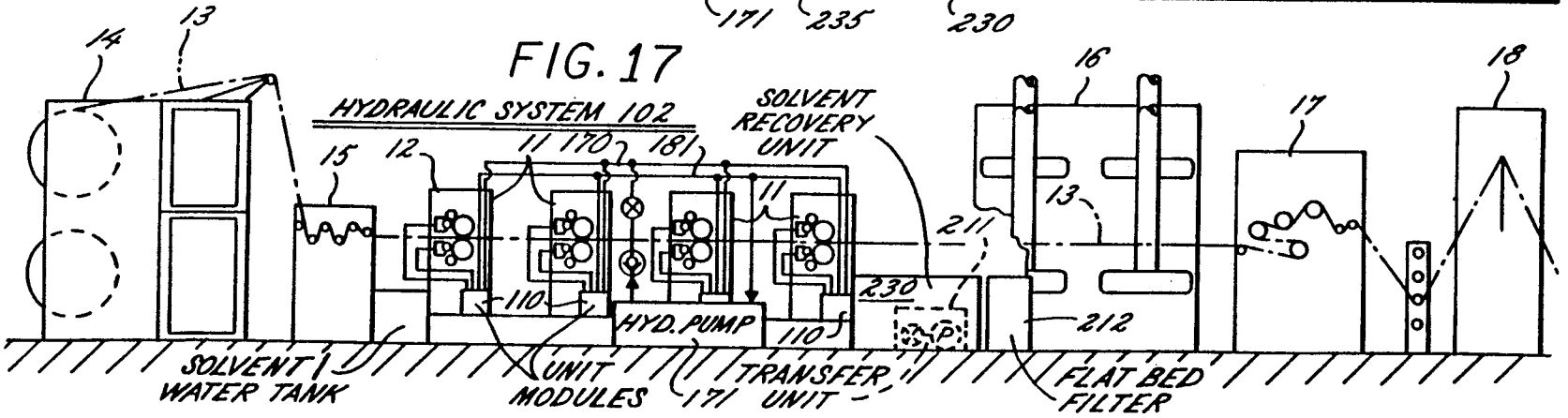
FIG. 17 is a side elevational view of the printing line shown in FIG. 16.

In order to control the speed of brush roller rotation during a cleaning operation, each module 110 is connected to a main hydraulic supply line 170, which preferably is adapted for supplying hydraulic fluid at a pressure on the order of 1200 psi and at a flow rate of at least two gallons per minute, per module under the operation of a hydraulic pump 171 (FIGS. 16, 17). The main hydraulic supply line 170 is connected to each module by a respective inlet line on the top side thereof, as viewed in FIGS. 7–10, which in turn is connected to a selectively operable hydraulic control solenoid valve 174

Figure 8:
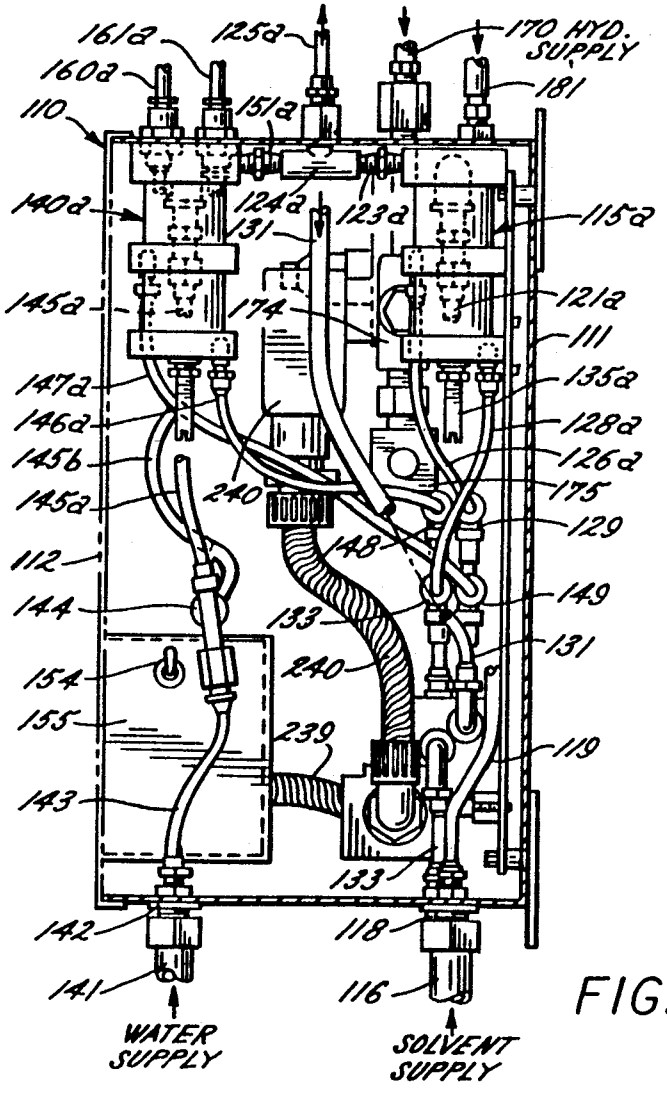
FIG. 8 is a vertical section of the control module, taken in the plane of line 8—8 in FIG. 7.

(FIG. 8). The hydraulic control solenoid 174 is connected to a hydraulic supply manifold 175 (FIG. 7) which communicates through respective pressure compensating flow control valves 176*a*, 176*b* to supply lines 178*a*, 178*b* connected to the module through appropriate fittings, which in turn are connected to the respective hydraulic motors 37 for the upper and lower cleaning devices 22*a*, 22*b*. The pressure compensating flow control valves 176*a*, 176*b* may be selectively set to limit the hydraulic fluid flow to the supply lines 178*a*, 178*b* upon actuation of the hydraulic control valve 174, and hence, control the rotational speed of the brush rollers 24, which preferably may be on the order of 175 rpm. Hydraulic return lines 179*a*, 179*b* (FIG. 10) for the hydraulic motors 37 of the upper and lower cleaning devices 22*a*, 22*b* are connected to the module by fittings, which in turn are connected to a common hydraulic fluid return manifold 180 (FIG. 7). A single return line connects the return manifold 180 to the main hydraulic return line 181 through an outlet fitting, in this instance again located on the top side of the module 110, for completing a closed loop hydraulic circuit.

Figure 11:
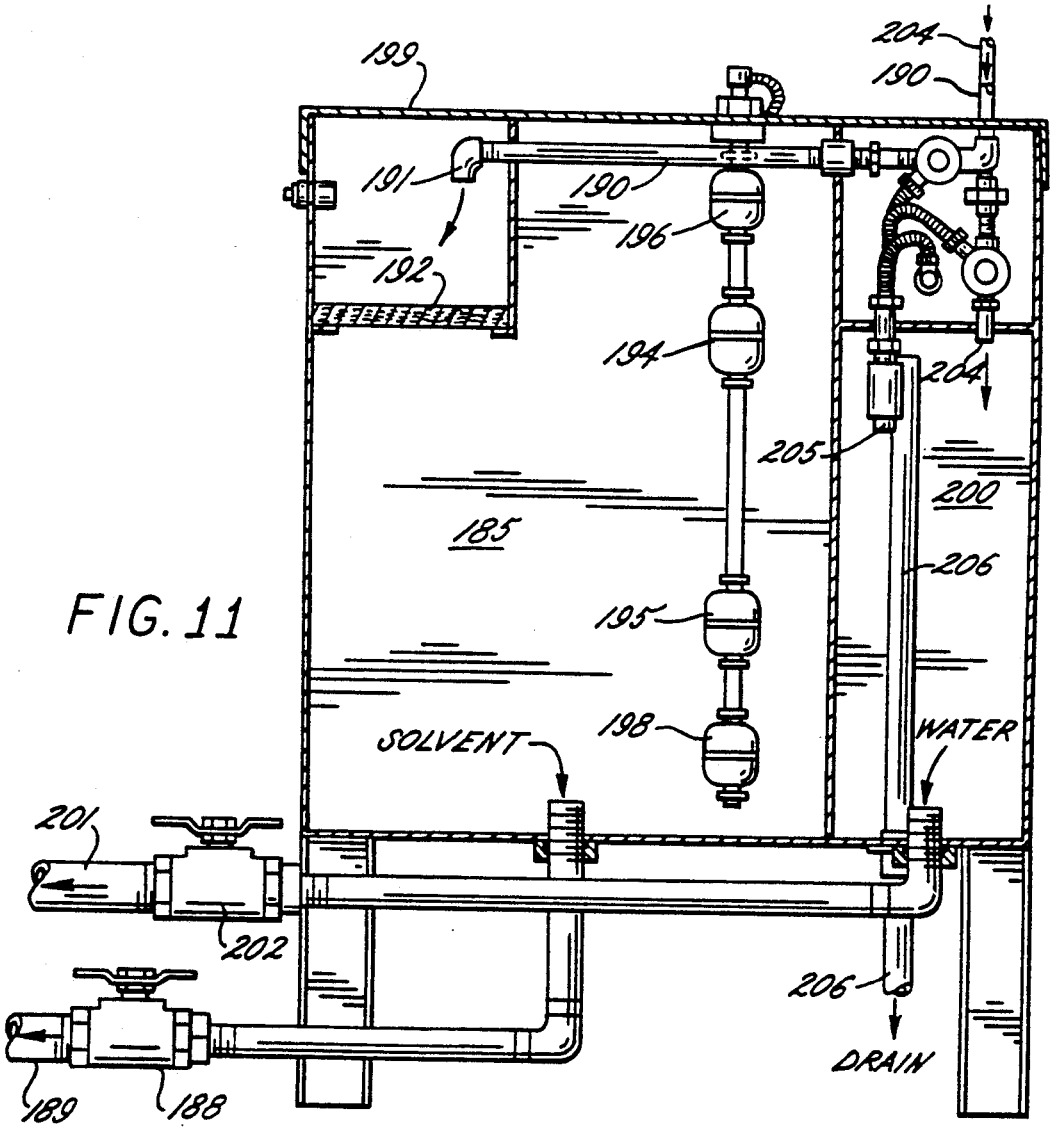
FIG. 11 is a vertical section of the solvent and water supply tank for the cleaning system.

For supplying solvent to the modules 110, the solvent supply system 100, as best depicted in FIGS. 1, 2 and 11, includes a solvent supply tank or reservoir 185 housed within a cabinet 186, which in the illustrated embodiment is located upstream of the first printing unit 11. The solvent supply tank 185 communicates through a control valve 188 with a main solvent supply line 189, which in turn is connected to the individual modules by the respective inlet supply lines 116. Solvent may be pumped to the reservoir 185 through a supply line 190 having a discharge end 191 that directs solvent into the tank through a filter compartment 192. The operation of the pump, and hence the quantity of solvent directed to the tank, is controlled by high and low level float valves 194, 195, respectively. For indicating extreme overflow or empty conditions and for initiating an appropriate alarm in either event, in the illustrated embodiment, overflow and empty float valve indicators 196, 198 are disposed above and below the high and low load float valves 194, 195, as shown in FIG. 11. It will be understood that solvent from the tank 185 will feed the main supply line 189 by gravity flow and will be drawn through the modules and directed out of the supply lines 125*a*, 125*b* upon operation of the positive displacement pumps 115*a*, 115*b* for the respective module. Alternatively, solvent could be manually supplied to the solvent supply reservoir tank 185 by raising a pivotal lid 199 of the cabinet 186 and pouring solvent through the filter compartment 192.

Figure 10:
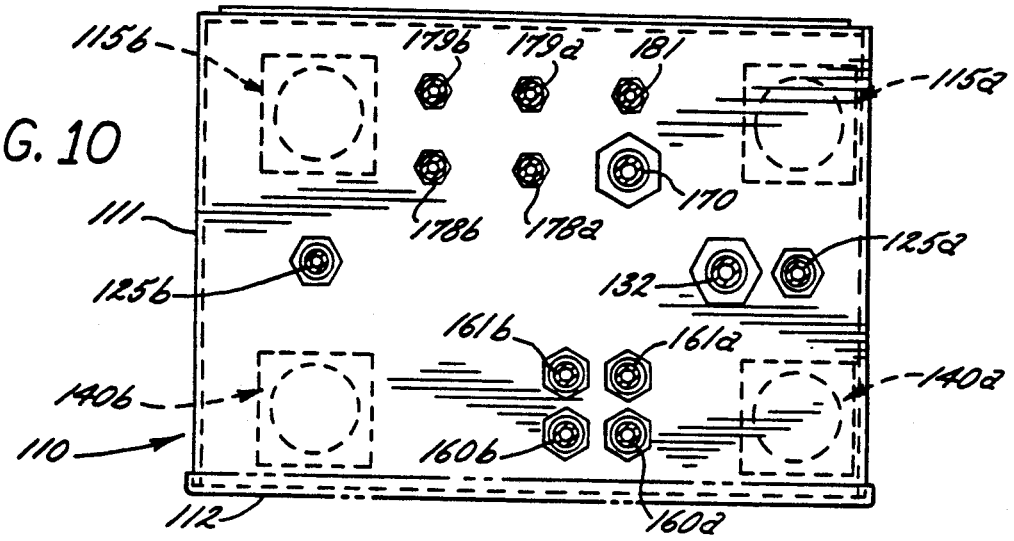
FIG. 10 is a top plan view of the module taken in the plane of line 10—10 in FIG. 7.
Figure 14:
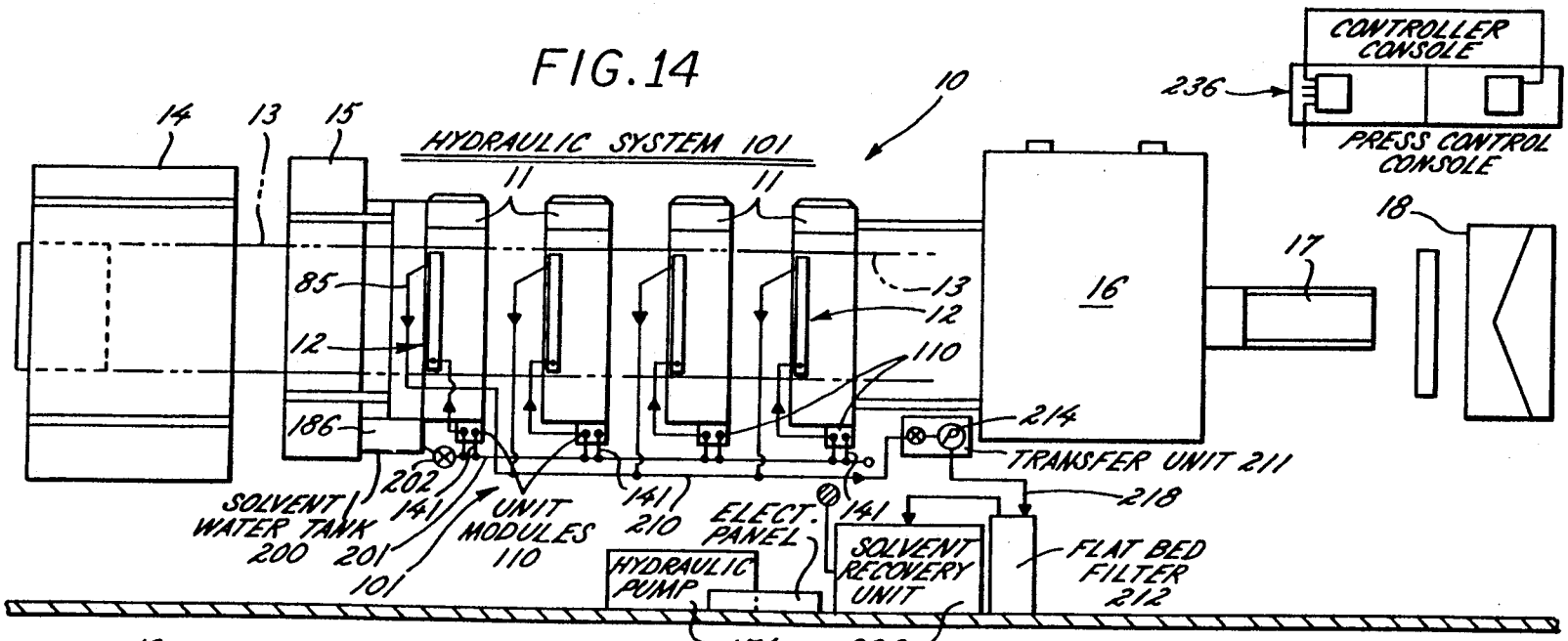
FIG. 14 is a top plan view of the printing line, similar to FIG. 1, but particularly depicting the water supply for the cleaning system.
Figure 15:
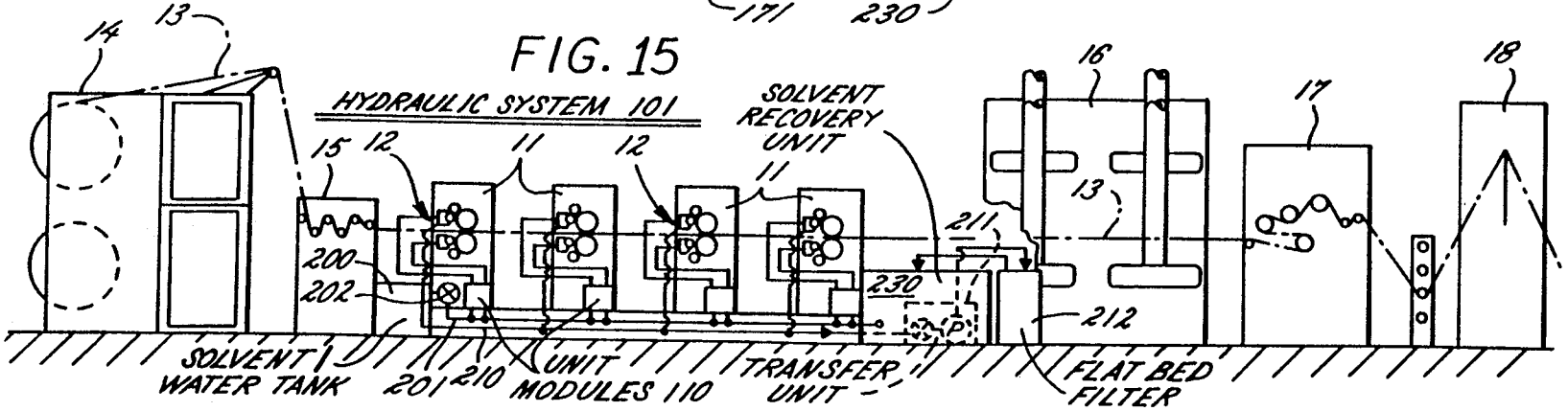
FIG. 15 is a side elevational view of the printing line shown in FIG. 14.

For supplying water to the modules 110 for use in the cleaning devices 22*a*, 22*b*, the water supply system 101, as best depicted in FIGS. 10, 14 and 15, includes a water supply reservoir or tank 200, which for compactness in design, is contained within the same cabinet 186 as the solvent supply reservoir tank 185. The water supply tank 200 similarly feeds a main water supply line 201 through a control valve 202, and the main supply line 201 communicates with the respective supply lines 141 for the modules 110. The water supply tank 200 has a supply line 204, which may be fed by the plant water supply line and operated under the control of a float valve 205 for maintaining a determined level of water in the tank. To prevent overflow, the water tank 200 in this instance has a stand up pipe 206 adapted for draining water that exceeds the upper end of the stand up pipe 206.

Waste effluents from the printing cylinder cleaning devices, which includes the solvent and water applied to the brush rollers and blanket cylinders as well as inks and foreign matter removed therefrom, are directed from the drains 85 of the respective cleaning devices 22*a*, 22*b* to a solvent recovery system. In the illustrated embodiment, the drains 85 each connect with a main return line 210 that feeds a waste effluent transfer unit or tank 211 (FIGS. 1, 2, 12–15). Waste effluent received in the transfer tank 211 (FIG. 12) is directed to a flat bed filter apparatus 212 (FIG. 13) upon operation of an air operated pump 214 disposed on top of the transfer unit 211. The pump 214 has a waste effluent inlet pipe 215 extending in depending relation to the bottom of the transfer tank with a screened inlet 216 through which liquid is drawn upwardly from the tank and directed through a discharge line 218. Pressurized air to the pump is controlled by a solenoid valve 219, as will become apparent, which in turn is actuated by a float valve 220 within the tank when the level of waste effluent in the tank exceeds the predetermined level as established by the float valve 220. A pressure regulator 221 controls the air pressure to the pump, and hence, the speed at which the pump directs fluids out of the transfer tank 211 to the filter bed apparatus 212.

The filter bed apparatus 212 may be of a conventional type having a selectively advanceable filter medium 225 upon which waste effluent from the discharge line 218 is dispersed. When the accumulated solids on the filter medium 225 exceeds a predetermined weight, a motor within the filter bed apparatus 212 is automatically energized to advance the filter medium 225 for bringing a clean section thereof under the discharge end of the line 218 and moving the previously used section to a location which dumps the accumulated solids thereon into receptacle 226.

The waste effluent passing through the filter medium 225 is pumped from the filter bed apparatus 212 to a solvent recovery unit 230, which may be of a conventional coalescer type operable for separating the solvent and water from the waste effluent. Water discharging the solvent recovery unit 230 may be added to the water supply tank for re-use. Solvent exiting the solvent recovery unit 230 may be passed through a final carbon filter for removing color pigment and other impurities and then collected for reuse in the system.

Figures 18, 19:
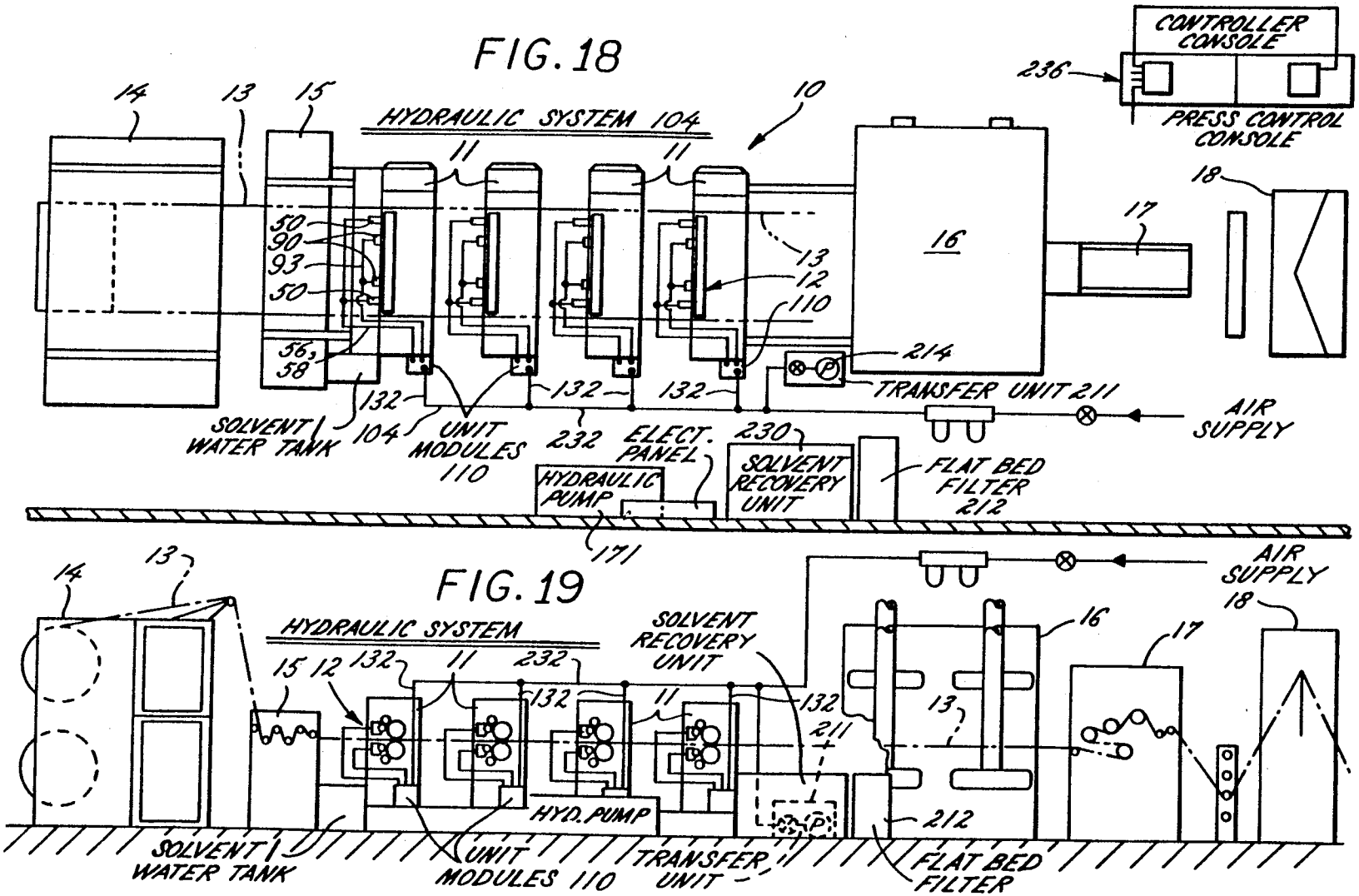
FIG. 18 is a top plan view of the printing line, particularly depicting the pneumatic supply for the cleaning system.
FIG. 19 is a side elevational view of the printing line shown in FIG. 18.

The pneumatic system 104, as best depicted in FIGS. 18 and 19, includes a main pressurized air supply line 232 that typically would be connected to the pressurized air supply in the plant in which the printing line is operating. The main pressurized air supply line 232 is connected to the respective supply lines 132 for the modules 110, as well as to the pneumatic pump 214 for the transfer unit 211 of the solvent recovery system.

Figure 20:
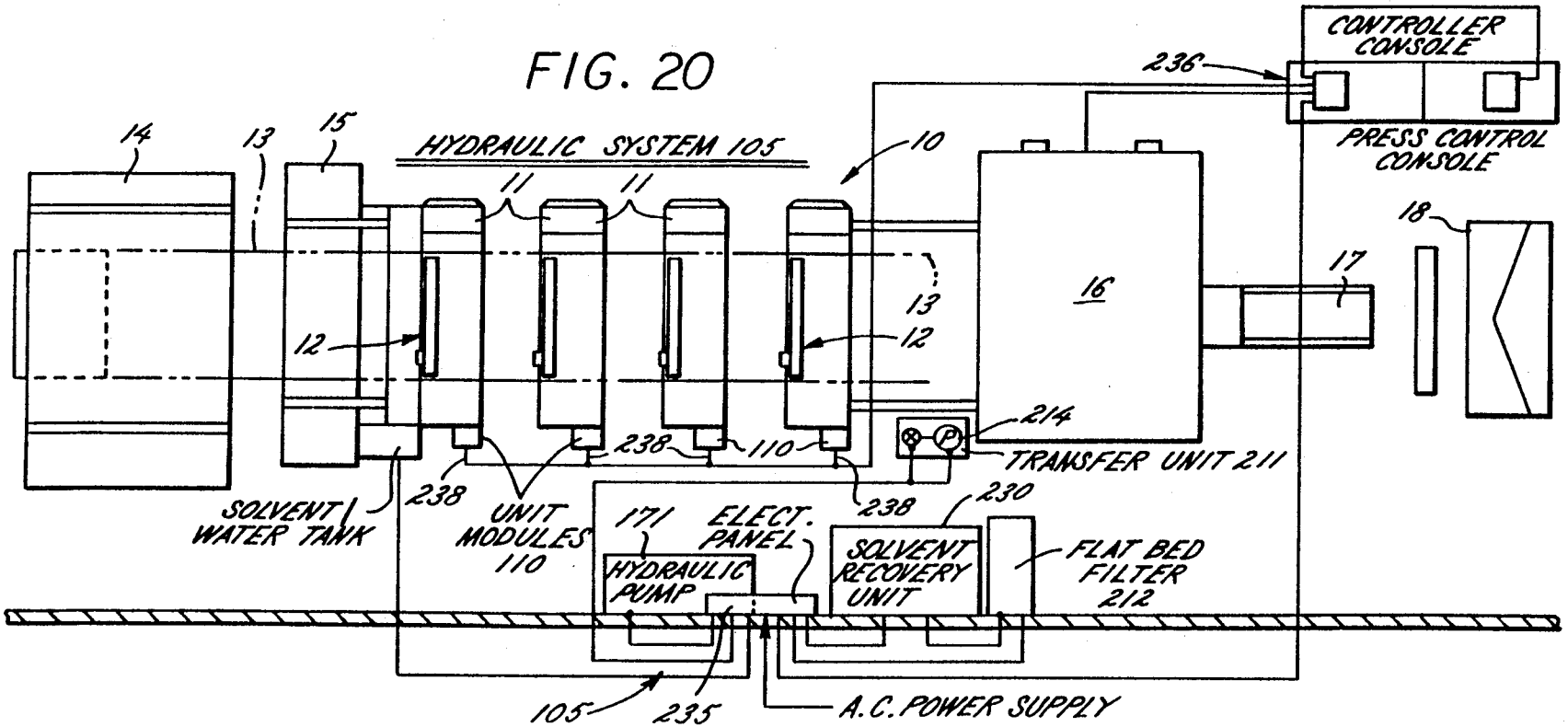
FIG. 20 is a top plan view of the printing line, particularly depicting the electrical supply for the cleaning system.

The electrical system 105 of the printing cylinder cleaning system is depicted in FIG. 20. An AC power supply is connected to main electrical panel 235 which in turn provides the necessary power to the hydraulic pump 171, solvent recovery unit 230, flat bed filter apparatus 212, and the transfer unit 211. The electrical panel 235 further is connected to a microprocessor based controller 236 that communicates with each of the modules 110 through a respective electrical inlet 238 and the module control panel 155. Each module control panel 155 (FIGS. 8 and 9) in turn is connected to module control solenoids 130, 150, 156 through a conduit 239, as well as to the hydraulic control solenoid 174 through the conduit 240. Hence, the module control solenoids 130, 150, 156, 174 may be either manually controlled, or automatically controlled by the controller. As indicated previously, a manually actuatable switch 154 is provided on the module control panel 154 for deactuating the water supply control solenoid 150 in the event that it is desired to carry out the cleaning operation only with solvent. The controller 236 also preferably is interfaced with the dryer 16 so that prior to the initiation of a printing cylinder cleaning operation the dryer is automatically set to a maximum condition for accommodating the amount of solvent that will be applied to the web and carried into the dryer during the cleaning operation.

In operation of the printing cylinder cleaning system 12, when the blankets on the blanket cylinders 19*a*, 19*b* of the printing units 11 are to be cleaned, the process may be initiated when the controller 236 receives either by an operator initiated signal or an automatic signal prompted by other operating stations of the printing line. Immediately after the signal to the controller 236 for initiating the blanket cleaning operation, the controller will signal to the dryer 16 to prepare for the cleaning operation, such as by establishing a maximum exhaust and purging condition for accommodating the solvents that will be carried by the moving web into the dryer during the cleaning cycle. When a return signal to the controller 236 indicates that the necessary dryer conditions have been met, a signal may be directed to the hydraulic fluid control solenoid 174 to permit communication of pressurized hydraulic fluid to each hydraulic motor 37 for rotating and oscillating the brush rollers 24 of the cleaning devices 22*a*, 22*b* in preparation for the cleaning operation. A signal to the modular scrub control solenoid 156 will permit communication of pressurized air to the air cylinders 50 for moving each brush unit 14 from its inoperative removed position to its operative position with the brush roller 24 engaging the blanket cylinder. During the scrubbing cycle, a series of controlled volume shots of solvent or solvent and water mixture may be applied to the brush rollers 24 through appropriate signals from the controller 236 to the solvent and water control solenoids 130 and ISO. It will be understood that the volume of solvent or solvent/water mixture may be determined by a program selected by the operator, depending upon the capacitor of the dryer. During such scrubbing cycle, the flicker bar 65 of each cleaning device 22*a*, 22*b* is in an inoperative or retracted position, as shown in solid lines in FIG. 6, and hence, does not cause the brush roller 24 to impart increased reactionary bearing forces against the blanket cylinder, nor cause the premature removal of solvents from the brush roller during the course of the cleaning operation, nor resist the driving motion of the brush roller, all as is typical in prior art blanket washers.

Upon completion of the scrubbing cycle, the brush unit 14 may be moved from its operative position to its retracted position upon deactuation of the modular scrub solenoid 156 and resulting communication of pressurized air to the air cylinders 50 through the supply lines 58, and at the same time, the flicker bar 65 may be moved from its inoperative position to its operative position in engagement with the respective brush roller 24 through communication of pressurized air through the supply line 93. Continued rotary movement of the brush roller 24 results in the flicker bar 65 stripping and cleaning the brush roller of foreign matter, solvent and water by the flicking action of the brush bristles 24 sequentially passing over the flicker bar surface 66. Because the brush roller 24 is disengaged from the respective blanket cylinder, the brush roller may be driven during the brush cleaning cycle without the resistance of the brush roller's engagement with the blanket cylinder. Solvent and foreign matter stripped from the brush roller during the cleaning operation is directed through the discharge opening 70, removable tray 71, and in turn to the trough 82 and drain line 85 for direction to the main return line 210 to the transfer unit tank 211. The waste effluent in the transfer tank 211 is pumped to the flat bed apparatus filter 212, and in turn is directed to the solvent recovery unit 230 where solvent may be separated for reuse in the system.

Figure 21:
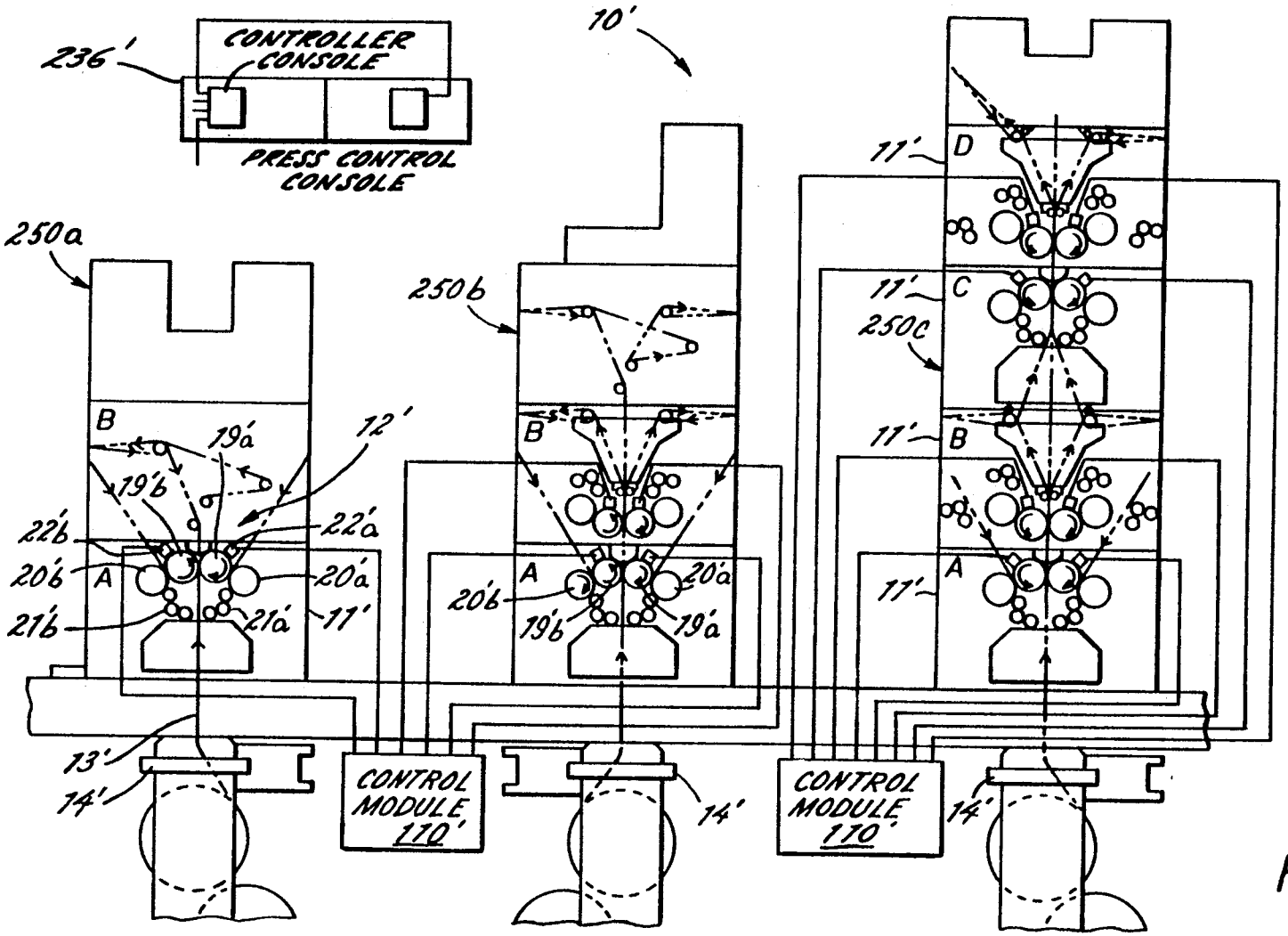
FIG. 21 is a diagrammatic depiction of a multiple vertical tower newspaper printing line having a blanket cleaning system according to the invention.
Figure 22:
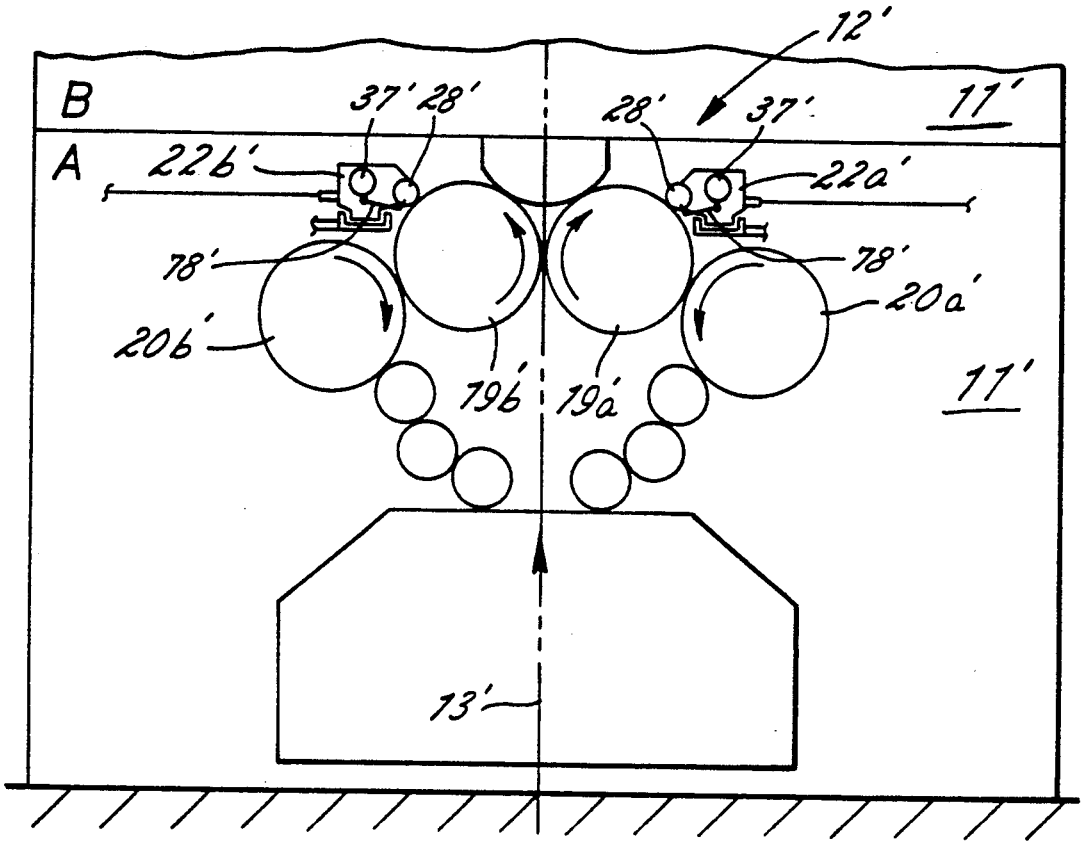
FIG. 22 is an enlarged depiction of one of the printing units in the printing line shown in FIG. 21.

Referring now more particularly to FIGS. 21 and 22, there is shown a newspaper printing line 10' having a blanket cylinder cleaning system 12' in accordance with the invention, wherein items similar to those described above have been given similar reference numerals with the distinguishing "'" added. The newspaper printing 10' line includes a plurality of individually configured printing towers 250*a*, 250*b*, 250*c*, three of which are illustrated. Each printing tower 250*a*, 250*b*, 250*c* includes one or more printing units 11' and a respective roll stand 14' from which a respective web 13' of paper is drawn into the printing tower. The printing tower 250*a* in this instance includes a single printing unit 11', the printing tower 250*b'* includes two printing units 11' in vertically stacked relation to each other, and the printing tower 250*c* includes four vertically stacked printing units.

Each of the printing units 11' includes a pair of blanket cylinders 19*a'*, 19*b'*, which defines a nip through which webs to be printed pass, and each blanket cylinder 19*a'*, 19*b'* has an associated printing cylinder 20*a'*, 20*b'*, an ink feed 21*a'*, 21*b'*, and a blanket cleaning device 22*a'*, 22*b'*. The cleaning devices 22*a'*, 22*b'* each are identical to the cleaning devices 22*a*, 22*b* previously described, including a rotatable brush roller 28' that is selectively movable into and out of engagement with the blanket cylinder.

For simplicity, only the printing unit 11*a'* of the tower 250*a* has been completely labeled with reference numerals. Webs of paper are drawn from the roll stands 14' of the respective towers 250*a*, 250*b*, 250*c* through selected printing units 11' of the associated tower, as well as through selected printing units of other of the printing towers for the desired printing operation, and the plurality of webs are then brought together, cut, and folded into a completed newspaper, as is known in the art.

In carrying out a feature of this embodiment of the invention, the blanket cleaning devices 22*a'*, 22*b'* are mounted on an outboard or downstream side of the respective blanket cylinder 19*a'*, 19*b'* in relation to the nip between the pairs of blanket cylinders through which the web is passing, for cleaning the blanket cylinders of lint and other debris during a printing run. In this regard, by mounting the cleaning devices 22*a'*, 22*b'* downstream of the nip, the cylinder is cleaned after the image it is carrying has been applied to the web. As best shown in FIG. 22, each blanket cleaning device 22*a'*, 22*b'* is adaptable for moving the brush roller 28' into contact with the blanket cylinder 19*a'*, 19*b'* at a point downstream of where the image is transferred to the web 13'. It has been found that by rotatably driving the brush rollers 28' while in periodic engagement with the blanket cylinder 19*a'*, 19*b'* without the simultaneous application of cleaning solvent to either the brush rollers or to the blanket cylinder, the blanket cylinders can be maintained in a clean condition during the course of a printing operation without adverse effect on the newspaper printing quality so long as the brush rollers remain in a relatively clean condition.

In carrying out a further feature of the invention, the brush roller 28' of each cleaning device 22a', 22b' is selectively cycled between an engaging relation with the blanket cylinders 19a', 19b' to a remote position for cleaning the brush roller of debris, ink and other contaminants accumulated therein from the blanket cylinder, and thereby enabling the brush roller to continue to effectively clean the blanket cylinder during the course of a printing run. In this regard, it is presently contemplated to provide for automatic periodic engagement of the cleaning device during a printing run of the printing units. The frequency of the periodic engagement and the length of the engagement is in part dependent on the particular specifications of the printing units and, therefore, the precise time periods are expected to be determined empirically. An example of what may be a satisfactory frequency of the periodic engagement and the duration of each engagement is ten (10) minutes between engagements, each having a duration of eight (8) seconds. Each engagement and removal is hereinafter referred to as a "cleaning cycle."

The printing units 11' of each tower 250a, 250b, 250c are controlled by a respective control module 110', which includes the components for controlling operation of the printing cylinder cleaning devices for the tower. In the illustrated embodiment, as depicted in FIG. 21, the cleaning units 11' for the towers 250a and 250b are controlled by a common control module 110', and the cleaning units 11' for the tower 250c are controlled by a separate module 110'. The control modules 110' may be constructed substantially similar to those previously described, but with duplicative components for controlling a multiplicity of cleaning units 11'. In other words, the control module 110' includes pumps and control components for controlling the cleaning devices 22a', 22b' for the printing unit 11' in the tower 250a, as well as pumps and control components for controlling the operation of the cleaning devices 22a', 22b' for the two printing units 11' in the tower 250b. For simplicity, in FIG. 21, each cleaning device 22a', 22b' is shown as being coupled to the respective control module 110' by a single line, representative of the hydraulic, electrical and pneumatic connections to the control module. Because each control module 110' in this instance is controlling a multiplicity of printing units 11', alternatively, the hydraulic supply to each tower could be supplied and controlled by an independent valve controlled supply line controlled remotely from the modules 110'.

In keeping with a further feature of the invention, the cleaning devices 22a', 22b' for each printing unit 11' in the multiplicity of printing towers are controlled through a master controller 236'. The master controller 236' is microprocessor-based and comprises an architecture of conventional design. The master controller 236' is programmed to automatically execute cleaning cycles at predetermined time intervals. Since all of the cleaning devices 22a' and 22b' under program control from the master controller 236' are of the same structure, the following description is made with reference to only one of the cleaning devices 22a'. It will be understood, however, that both of the cleaning devices 22a' and 22b' are similarly controlled by the master controller 236'. Furthermore, it should also be understood that it is presently contemplated that both of the cleaning devices 22a' and 22b' for each of the printing units 11' are automatically cycled by the master controller 236' as described hereinafter. There may be situations, however, that result in a system wherein less than all of the cleaning devices 22a' and 22b' of all of the printing units 11' are cycled under program control. In any event, the following description is with reference to a single cleaning device 22a' for ease of description only.

In keeping with this further feature of the invention described in connection with FIGS. 21-23, the cleaning device 22a' is normally removed from the blanket cylinder 19a' during a printing run. Periodically, the control module 110' in response to the master controller 236' causes the cleaning device 22a' to move into engaging relation with the blanket cylinder 19a' for a predetermined time period in order to execute a cleaning cycle. After the predetermined time period has elapsed, the cleaning device 22a' is removed from the blanket cylinder 19a', but the brush roller 28' continues its rotary motion for a short time period after the device has been removed in order to remove lint and debris collected from the blanket cylinder. No solution or solvents are applied to the brush 28'. Hence, this cleaning cycle is called a "Dry Cycle Program" to distinguish it from a cleaning cycle that applies solution and solvents to the brush 28', which is called a "Wet Cycle Program."

In an automatic mode of operating the cleaning system 12' (hereinafter called an "Automatic Cycle Program"), the cleaning device 22a' is periodically engaged during printing runs. In this mode of operation, the Dry Cycle Program is employed in order to avoid contaminating the brush roller 28' with solutions and solvents that would be otherwise transferred to the blanket cylinder 19a' and the web 13', which is unacceptable during a printing run. After some number of runs, the cleaning device 22a' is engaged and the cleaning solutions and solvents are applied to the brush roller 28' to clean the blanket cylinder in substantially the same way described in connection with FIGS. 1-20, except that the flicker 78' is static and remains in an engaged position at all times during a cleaning cycle.

From time to time, it may be advantageous to clean the brush roller 28' of the cleaning device 22a' when the device is removed from the cylinder 19a'. For example, after the cylinder 19a' has been cleaned, the brush roller 28' may remain less than satisfactorily rinsed of lint and debris. In order to thoroughly clean the brush roller 28' without necessitating further (and unnecessary) cleaning of the cylinder 19a', the master controller 236' is programmed to respond to a user-selected switch at the controller console to apply cleaning solution and solvent and rotate the brush roller 28' for a predetermined time period, while the cleaning device 22a' remains removed from the blanket cylinder.

In keeping with the invention, a user-selected switch at the control console when activated overrides the automatic cycling of the cleaning device 22a' to effectuate an immediate cleaning cycle. Upon activation of such an override, the period of the automatic cleaning cycle is reset. For example, if the master controller 236' is programmed to initiate a cleaning cycle every ten minutes during a printing run and an operate manually initiates a cleaning cycle at the eighth minute into the period, the ten-minute period will be reset to begin at the end of the manually initiated cleaning cycle. Therefore, the master controller 236' will in effect reset the ten minute time period in response to the manual override.

Each of the Dry Cycle Program and Wet Cycle Program cleaning cycles includes scrub and spin cycles. During the scrub cycle, the cleaning device 22a' is engaged with the blanket cylinder 19a' and the brush motor 37' drives the brush roller 28' in a rotary motion against the surface of the blanket cylinder. After the scrub cycle is completed, the spin cycle begins. During the spin cycle, the cleaning device 22a' is removed from the blanket cylinder 19a', but the brush roller 28' continues to rotate. If the cleaning cycle executed by the system is a Dry Cycle Program, no solution or solvent is applied during the spin cycle. Nevertheless, some amount of cleaning of the brush roller is effected because the flicker 78' is engaged.

In response to a command to engage the cleaning device 22a' with the blanket cylinder 19a' in order to execute a cleaning cycle, the master controller 236' generates a timed sequence of electrical signals to the control module 110', which controls the solenoids of the appropriate valves. The timed sequence of electrical signals can be user selected at any time by activation of the appropriate switch at the control console of the master controller 236'. Alternatively, the timed sequence is initiated automatically by the master controller 236' at periodic intervals—i.e., the Automatic Cycle Program.

Figure 23:
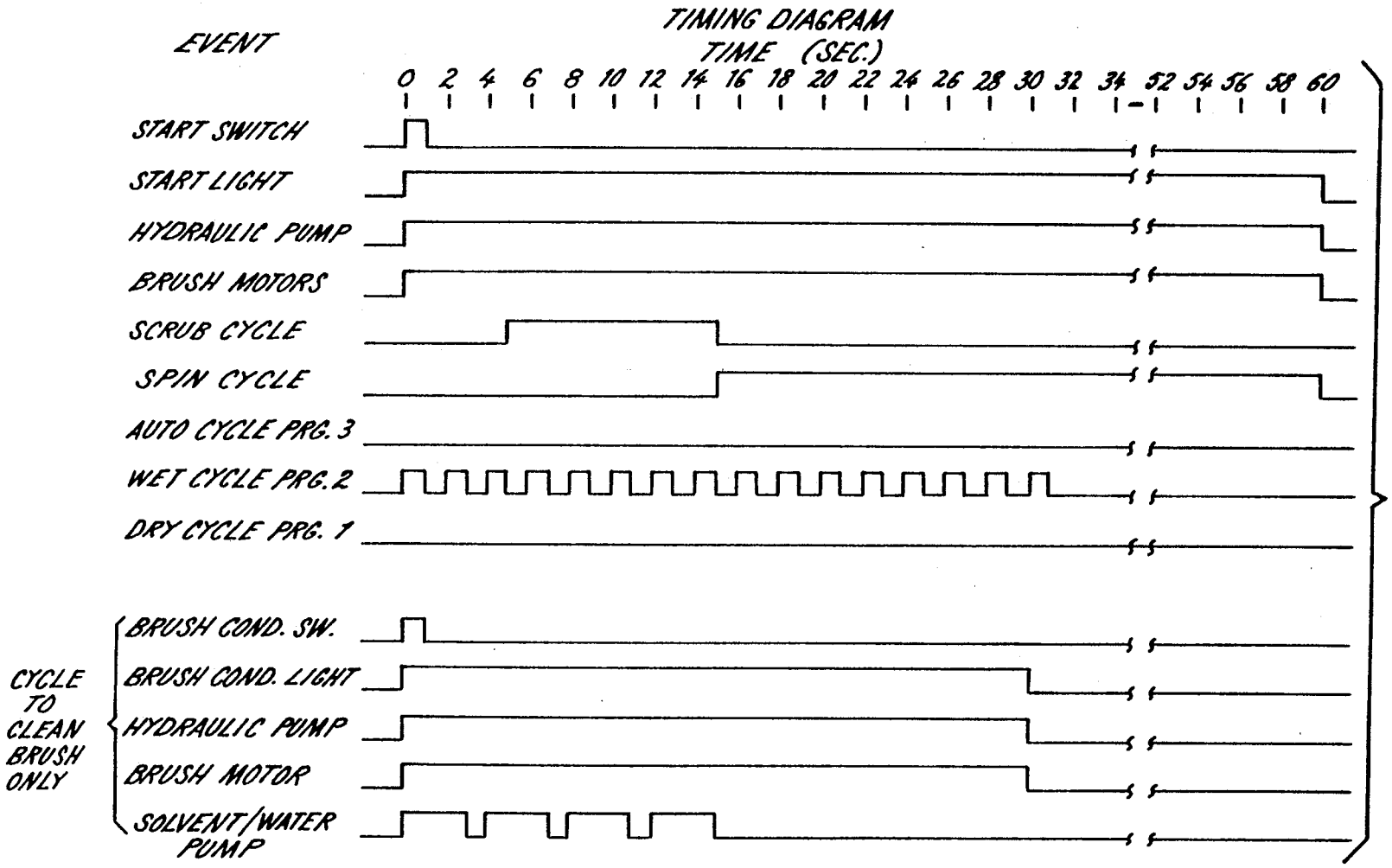
FIG. 23 is an exemplary timing diagram of the electrical pulses that control the cleaning system of FIGS. 21 and 22.

Turning to FIG. 23, a start switch (not shown) at the control console of the master controller 236' generates a pulse when selected by a user that initiates the sequence of signals, which execute a cleaning cycle. Depending upon the switch selected, either a Wet Cycle Program or a Dry Cycle Program is initiated. Immediately upon activation of the start switch, the hydraulic pump and the brush motor of the cleaning device 22a' are turned on. In order to visually indicate that the master controller 236' is responding to the selection of the start switch by a user, a start light pulse is generated for the duration of the cleaning cycle, which is delivered to a light on the console.

In the sequence illustrated in the timing diagram of FIG. 23, the length of the cleaning cycle is approximately 60 seconds. It will be appreciated that the length of the cycle and the relative duration of each electrical pulse is only illustrative. The precise length of the cycle and the relative durations of the pulses are expected to be empirically fine-tuned at each installation.

After the rotary speed of the brush 28' has been brought up to speed, the cleaning device 22a' is brought into engagement with the blanket cylinder 19a'. In the timing diagram of FIG. 23, the cleaning device 22a' is engaged five (5) seconds after the cleaning cycle is initiated by the start switch pulse. The brush 28' remains engaged with the blanket cylinder 19a' for eight (8) seconds as indicated by the scrub cycle pulse. At the end of this eight (8) second period, the cleaning device 22a' is removed as indicated by the spin cycle pulse. The cleaning device 22a' is positively maintained in its removed position during the remainder of the 60 second cycle as the brush roller 28' continues to rotate as the timing diagram indicates. With the flicker 78' engaged, the continued rotary motion of the brush roller 28' cleans the roller of a significant amount of the lint and debris collected from the blanket cylinder 19a' during the scrub cycle.

When the master controller 236' is executing the Automatic Cycle Program, each cleaning cycle is a Dry Cycle Program—i.e., the solenoid valve controlling delivery of solvents and solutions to the brush roller 28' is closed at all times as indicated by the timing diagram. Correspondingly, manual selection of the Dry Cycle Program maintains the solenoid valve for the solvents and solutions in an inactive state as indicated by the timing diagram. Manual selection of a Wet Cycle Program, however, pulses the solenoid valve to meter solution and solvent to the brush roller 28' for the duration of the cleaning cycle. The Wet Cycle Program is only used between or after printing runs and not during the runs. The duration of the on time and the ratio of the on/off time for the pulses controlling the metering of the solvent and solution as shown in the timing diagram are merely exemplary. As presently contemplated, the precise timing is determined empirically at each installation.

In response to selection by a user of the appropriate switch at the console of the master controller 236', a brush conditioning pulse initiates a sequence of pulses that cleans the brush roller 28' of the cleaning device 22a' while the device is removed from the blanket cylinder 19a'. In this connection, selection of the appropriate switch at the console causes the master controller 236' to generate a "brush conditioning light" signal as indicated for the duration of the brush cleaning cycle (e.g., 31 seconds in the exemplary timing diagram). The brush roller 28' is rotated as indicated by the signals provided to the hydraulic pump and the brush motor. Unlike the foregoing Automatic, Wet and Dry Cycle Programs, however, the solenoids for moving the cleaning device 22a' are not activated. With the cleaning device 22a' removed from the blanket cylinder 19a', solvents and solutions are metered to the brush roller 28' in accordance with the pulses indicated in the timing diagram. Again, the duration of the pulses and their on/off ratio are merely exemplary.

From the foregoing, it will be seen that the printing cylinder cleaning system of the present invention is adapted to permit more precise control in the amount of solvent used during the cleaning operation, and hence, enables more reliable determination of the maximum number of printing units that may be simultaneously employed in a printing operation without creating a potentially dangerous condition in the dryer of the printing line. The control modules associated with each printing unit permit close proximity control of the printing cylinder cleaning operation and facilitates installation and service through standardized connections between the cleaning devices of each printing unit and the outside solvent, liquid, hydraulic, pneumatic, and electrical sources. Since the flicker bar is movable to a disengaged condition from the brush roller during the cleaning cycle, lesser amounts of solvent are required during the cleaning cycle, and the brush roller may be operated at higher speeds with lesser tendencies for undesirable vibration. The blanket cleaning system also is readily adaptable for cleaning blanket cylinders in large newspaper printing lines without interruption of the printing operation, without incurring paper waste, and with minimal use of volatile organic solvents. In such newspaper printing lines, the blanket cleaning system is adaptable for automatically controlled selective wet and dry operating modes for maintaining the brush rollers of the cleaning devices in clean condition for optimum cleaning.

I claim as my invention:

1. A printing cylinder cleaning system for a printing line having a plurality of printing units each having first and second printing cylinders comprising a cleaning device associated with each printing cylinder, said cleaning devices each including a brush roller, means for moving said brush roller laterally into and out of engagement with the associated printing cylinder for removing inks and foreign matter on said cylinder, a control module associated with said plurality of printing units, a master controller remote from said control module, and said control module being connected to said master controller and including means selectively operable under the control of said master controller for controlling operation of said brush roller moving means for the cleaning devices of said plurality of printing units.

2. The printing cylinder cleaning system of claim 1 further comprising a flicker bar for removing foreign matter from said brush roller, wherein the flicker bar selectively engages said brush roller only when said brush roller is out of engagement with the associated printing cylinder.

3. The printing cylinder cleaning system of claim 1 wherein the control module includes pump means for supplying a controlled quantity of a cleaning solvent to the brush roller.

4. The printing cylinder cleaning system of claim 3 further comprising a removable drain tray for accumulating foreign matter and excess cleaning solvent.

5. The printing cylinder cleaning system of claim 4 further comprising filter means for removing foreign matter from the excess cleaning solvent.

6. The printing cylinder cleaning system of claim 3 wherein the pump means includes electrically operable solenoids, the quantity of cleaning solvent supplied to the brush roller being regulated by operation of the solenoids in accordance with electrical signals from the master controller.

7. The printing cylinder cleaning system of claim 1 wherein the means for moving the brush roller laterally and the means for moving said brush roller in a rotary direction are operated by the master controller in an automatic cycle.

8. The printing cylinder cleaning system of claim 7 further comprising manual override means for operating the brush roller moving means independent of the automatic cycle.

9. A printing cylinder cleaning system for a newspaper printing line having a plurality of printing towers each having at least one printing unit, said printing units each having first and second printing cylinders, said cleaning system comprising a cleaning device associated with each printing cylinder, said cleaning devices each including a brush roller, means for moving said brush roller in a rotary direction, means for moving said brush roller laterally into and out of engagement with the associated printing cylinder for removing inks and foreign matter on said cylinder, the printing units of each tower being associated with a common control module, a master controller remote from said control module, and said control module being connected to said master controller and including means selectively operable under the control of said master controller for controlling at least some of the operations of said brush roller moving means for the printing units of the tower associated with the module.

10. The printing cylinder cleaning system of claim 9 further comprising a flicker bar for removing foreign matter from said brush roller, wherein the flicker bar selectively engages said brush roller only when said brush roller is out of engagement with the associated printing cylinder.

11. The printing cylinder cleaning system of claim 10 further comprising a removable drain tray for accumulating foreign matter and excess cleaning solvent, and filter means for removing foreign matter from the excess cleaning solvent.

12. The printing cylinder cleaning system of claim 9 wherein the control module includes pump means for supplying a controlled quantity of a cleaning solvent to the brush roller.

13. The printing cylinder cleaning system of claim 12 wherein the pump means includes electrically operable solenoids, the quantity of cleaning solvent supplied to the brush roller being regulated by operation of the solenoids in accordance with electrical signals from the master controller.

14. The printing cylinder cleaning system of claim 9 wherein the means for moving the brush roller laterally and the means for moving said brush roller in a rotary direction are operated by the master controller in an automatic cycle.

15. The printing cylinder cleaning system of claim 14 further comprising manual override means for operating the brush roller moving means independent of the automatic cycle.

16. A printing cylinder cleaning system for a printing line having a printing unit that has a printing cylinder for printing to a web, the system comprising a cleaning device associated with the printing cylinder, the cleaning device including a brush roller, means for moving the brush roller in a rotary direction, means for moving the brush roller laterally into and out of engagement with the printing cylinder at a location downstream from where the printing occurs for removing inks and debris on said cylinder, a control module associated with said printing unit for controlling operation of the cleaning device, a master controller remote from and in communication with said control module for controlling said control module to selectively operate the brush roller moving means such that the brush roller is automatically cycled into and out of engagement with the printing cylinder during printing; and a flicker bar for removing foreign matter from the brush roller, wherein the flicker bar selectively engages the brush roller only when the brush roller is out of engagement with the associated printing cylinder.

17. The printing cylinder cleaning system of claim 16 wherein the control module includes pump means for supplying a controlled quantity of a cleaning solvent to the brush roller.

18. The printing cylinder cleaning system of claim 17 wherein the pump means includes electrically operable solenoids, the quantity of cleaning solvent supplied to the brush roller being regulated by operation of the solenoids in accordance with electrical signals from the master controller.

19. The printing cylinder cleaning system of claim 17 further comprising a removable drain tray for accumulating foreign matter and excess cleaning solvent, and filter means for removing foreign matter from the excess cleaning solvent.

* * * * *